US012673802B2

(12) United States Patent
Schoenlein et al.

(10) Patent No.: US 12,673,802 B2
(45) Date of Patent: Jul. 7, 2026

(54) CAN ENDS WITH ROUNDED RIVET BUTTONS

(71) Applicant: Stolle Machinery Company, LLC, Centennial, CO (US)

(72) Inventors: Bryan Lee Schoenlein, Minster, OH (US); Dennis Cornelius Stammen, Brookville, OH (US); Craig A. McEldowney, Russia, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 18/967,780

(22) Filed: Dec. 4, 2024

(65) Prior Publication Data

US 2026/0152321 A1 Jun. 4, 2026

(51) Int. Cl.
*B65D 17/40* (2006.01)
*B65D 17/28* (2006.01)

(52) U.S. Cl.
CPC ..... *B65D 17/4012* (2018.01)

(58) Field of Classification Search
CPC ..... B65D 17/4012; B65D 17/4011; B65D 17/401; B65D 17/4014; B21D 51/383; B21D 51/38
USPC ..... 220/272, 273, 270, 622, 623, 610, 600; 413/14, 12, 8
See application file for complete search history.

(56) References Cited

U.S. PATENT DOCUMENTS

| | | | |
|---|---|---|---|
| 3,346,948 | A | 10/1967 | Henning et al. |
| 4,145,801 | A | 3/1979 | Schrecker et al. |
| 4,685,849 | A | 8/1987 | LaBarge et al. |
| 11,691,193 | B2 | 7/2023 | Stammen et al. |
| 2012/0118891 | A1 | 5/2012 | Butcher et al. |
| 2023/0264855 | A1 | 8/2023 | Mentasti Granelli |
| 2023/0286033 | A1 | 9/2023 | Stammen et al. |

FOREIGN PATENT DOCUMENTS

| | | |
|---|---|---|
| JP | 62-64731 | 3/1987 |

OTHER PUBLICATIONS

U.S. Patent and Trademark Office, ISA/US, PCT/US2025/054277 International Search Report, Jan. 8, 2026, 17 pages.
U.S. Patent and Trademark Office, ISA/US, PCT/US2025/054483 International Search Report, Jan. 12, 2026, 11 pages.

*Primary Examiner* — Robert J Hicks
(74) *Attorney, Agent, or Firm* — Eckert Seamans Cherin & Mellott, LLC

(57) ABSTRACT

A can end includes a rivet button extending upward from the can end. The rivet button includes a head with a rounded profile. The rounded profile includes a plurality of curvatures. Each curvature has a distinct radius of curvature. The plurality of curvatures assists in forming the rivet button into a rivet.

13 Claims, 26 Drawing Sheets

CAN ENDS WITH ROUNDED RIVET BUTTONS

FIELD

The disclosed and claimed concepts relates to can ends and, more particularly, to can ends made from a sheet material with greater and/or more efficient recyclability, characterized as a material having a lower formability and/or less expense than typically used in the industry. The disclosed concepts also relate to tooling assemblies and associated methods for providing such can ends.

BACKGROUND

Metallic containers (e.g., cans) are structured to hold products such as, but not limited to, food and beverages. Generally, a metallic container includes a can body and a can end. The can body, in an exemplary embodiment, includes a base and a depending sidewall. The can body defines a generally enclosed space that is open at one end. The can end includes a container opening. That is, the can end includes an end panel and a tear panel. The end panel comprises the bulk of the can end and is generally planar. The tear panel defines the container opening. That is, the tear panel is a small portion of the end panel defined by a score line. The score line weakens the material of the end panel. As is known, a lift tab is coupled to the end panel adjacent the tear panel. When the lift tab is actuated, i.e., lifted, a portion of the lift tab engages the tear panel and causes the tear panel to move relative to the end panel. As the tear panel moves relative to the end panel, the tear panel and the end panel separate at the score line. As is known, the score line does not extend entirely about the tear panel. In this configuration, there is a connection tab, or hinge, that links the tear panel to the end panel. Thus, the tear panel does not fall into the beverage can body, but rather flexes toward the beverage can body so that a consumer may drink the liquid via the container opening. The score line, in an exemplary embodiment, includes two portions; a primary score and an anti-fracture score. The primary score and the anti-fracture score extend generally parallel to each other and are contiguous. That is, the two score lines are generally parallel to each other and include a curved transition portion extending between the generally parallel primary score and the anti-fracture score.

The can body is filled with product and the can end is then coupled to the can body at the open end. The container is, in some instances, heated to cook and/or sterilize the contents thereof. This process increases the internal pressure of the container. Further, the container contains, in some instances, a pressurized product such as, but not limited to a carbonated beverage. Thus, for various reasons, the container must have a minimum strength.

Generally, the strength of the container is related to the thickness of the metal from which the can body and the can end is formed, as well as, the shape of these elements. The can ends are "easy open" ends, which include the tear panel and the lift or pull tab. The tear panel is defined by a score profile, or the score line, on the exterior surface (identified herein as the "public side") of the can end. The tab is attached (e.g., without limitation, riveted) adjacent the tear panel. The pull tab is structured to be lifted and/or pulled to sever the score line and deflect and/or remove the severable panel, thereby creating an opening for dispensing the contents of the container.

When the can end is made, it originates as a blank, which is cut from a sheet metal product (e.g., without limitation, sheet aluminum, sheet steel). As used herein, a "blank" is a portion of material that is formed into a product; the term "blank" is applicable to the portion of material until all forming operations are complete. In an exemplary embodiment, the blank is formed into a "shell" in a shell press. As used herein, a "shell," or a "preliminary can end," is a construct that started as a generally planar blank and which has been subjected to forming operations other than scoring, paneling, rivet forming, and tab staking, as is known. The blank/shell is further formed into a can end in a conversion press. That is, further forming operations that convert a shell into a can end include scoring, paneling, rivet forming, and tab staking, as is known. In another embodiment, sheet material is cut and formed into a can end in a single press that performs all of the operations of both a shell press and a conversion press.

A shell press and/or a conversion press includes a number of tool stations where each station performs a forming operation (or which may include a null station that does not perform a forming operation). In a shell press, the blank moves through successive stations and is formed into the "shell." That is, as a non-limiting example, a first station cuts the blank from the sheet material, a second station forms the blank into a cup-like construct with a depending sidewall, a third station forms the depending sidewall into a countersink and a chuck sidewall, and so forth. In a conversion press, the shell is formed into a can end. That is, at least one station forms a "bubble." A bubble, as used herein, is the construct that is formed into a "rivet button" which, in turn, is formed into the rivet that couples the tab to the can end. As such, the formation of the bubble affects the characteristics of the rivet button and the rivet. As the shell advances from one tool station to the next, conversion operations such as, for example and without limitation, rivet forming, paneling, scoring, embossing, and tab staking (i.e., coupling a tab to the shell via the rivet), are performed until the shell is fully converted into the desired can end and is discharged from the press. Further, the process of creating a rivet and coupling a tab thereto are disclosed in U.S. Pat. No. 4,145,801 and the Description of the Preferred Embodiments in U.S. Pat. No. 4,145,801, which are hereby incorporated by reference. Accordingly, a shell/can end is formed in a press having a plurality of stations. The blank is moved intermittently, or as used herein "indexed," through the number of stations. That is, the blank is moved and stops at each station wherein a forming operation is performed (it is understood that some stations are "null" stations that do not perform a forming operation). In one known embodiment, a conversion press is structured to cut a blank from sheet material and form a can end.

A conversion press may include a number of bubble stations that are structured to form a bubble on the shell, a number of rivet stations that are structured to convert the bubble into a rivet button, and a staking station that is structured to couple a tab to the shell by staking (or flattening) the rivet button into a rivet and thereby completing the can end. In an exemplary embodiment, a conversion press includes one bubble station, a number of rivet stations, and a number of other forming stations structured to form known elements of a can end such as, but not limited to, scoring, paneling, and lettering, as well as a staking station wherein a tab is coupled to the shell by the rivet.

As shown in FIG. 1, a press structured to form a known aluminum beverage can; that is, a can structured to contain a beverage such as beer or carbonated beverages, i.e., a "soda" or "pop," and which is typically a twelve ounce container, includes a bubble station lower cap 2 and a bubble station lower punch 3 on a lower tooling assembly and a toroid bubble station upper punch 4 on an upper tooling assembly.

The can closure is formed in a forming assembly including a number of dies. As is known, the forming assembly converts a generally circular, generally planar blank into a can closure and includes dies structured to create an annular countersink, a rivet, and the score lines (i.e., the primary score and the anti-fracture score) that define the tear panel. In an exemplary embodiment, the score lines are formed by a single "score" die acting on the can closure blank. As used herein, a "score" die is the die that forms the score on the can closure blank.

For a beverage can closure, as well as others, the score die includes a body that is generally cylindrical and which is generally short, i.e., the height of the body is less than the diameter. That is, the score die body is a disk or "puck" like. The score die body includes two opposed, generally planar end surfaces and a number of openings. The openings include mounting couplings and a tear panel opening shaped to generally correspond to the shape of the resulting tear panel. On the "top" surface of the score die body is a "score blade." As used herein, the "top" surface of a die is the surface that performs forming operations on a blank. As used herein, a "score blade" is a ridge or other construct extending from the top surface of a die. In an exemplary embodiment, the score blade includes two cutting portions; a primary score blade portion and an anti-fracture score blade portion. The primary score blade portion and the anti-fracture score blade portion are, in an exemplary embodiment, contiguous and extend about the tear panel opening in a generally parallel configuration.

There is a need for a can end and/or score die that overcomes the problems identified above. There is a further need for a system to make such a can end or score die and a method of making same.

SUMMARY

The above-described needs, and others, are met by the various embodiments of the presently disclosed technology.

In the can making industry, large volumes of metal are required in order to manufacture a considerable number of cans. Thus, it may be desirable to increase the use of recyclable materials and transition to alloys having greater recyclability. Presently, can ends are made from sheet metal such as, but not limited to, aluminum and steel as well as alloys including those metals. Many alloys which are more efficiently recycled have different characteristics than materials more commonly used in the industry. For example, recycling-efficient alloys may be characterized by a lower formability and/or a lower cost.

Use of alloys with a lower formability and/or less expense, however, have been found to generate other problems such as, but not limited to, coin tearing at the bubble, stressing, and thinning at the rivet corners, increased loose metal during scoring that requires increased paneling, and weakening of the score during paneling, among other general concerns about tearing, uneven coining, and excess loose metal. These difficulties arise with alloys of these properties because they are resistant to localized forming, which can be prone to cracks or breaking during forming or failing to meet existing performance requirements. Previous tooling relied on this localized forming, and in turn resulted in too much stress (resulting in cracks/breaks) or would draw metal from unintended areas, thereby affecting performance requirements.

Using alloys with better recyclability, or using less aluminum generally, promotes a more sustainable can making operation and may reduce the industry's carbon footprint. Reusing recycled aluminum and using less non-recycled aluminum reduces the amount of consumable resources that are utilized in smelting, processing, and transporting large volumes of aluminum for can making. Using less aluminum also reduces the consumption of consumable resources during the can making process, such as electricity, gas, and water.

Characteristics (i.e., size, shape, contour, etc.) of the bubble/rivet button affect the performance of the final rivet. Further, seemingly small changes to the characteristics of the bubble/rivet button, as well as the tooling that forms the bubble/rivet button, affect the performance of the final rivet including strengthening the rivet and allowing for the use of a material with different qualities.

In one exemplary embodiment of the presently disclosed technology, a can end includes a rivet button extending upward from the can end. The rivet button includes a head with a rounded profile. The rounded profile includes a plurality of curvatures. Each curvature has a distinct radius of curvature.

BRIEF DESCRIPTION OF THE DRAWINGS

The following detailed description of the presently disclosed technology will be better understood when read in conjunction with the appended drawings, wherein like numerals designate like elements throughout. For the purpose of illustrating the presently disclosed technology, there are shown in the drawing's various illustrative embodiments. It should be understood, however, that the presently disclosed technology is not limited to the precise arrangements and instrumentalities shown. In the drawings.

DETAILED DESCRIPTION

Figure 1:
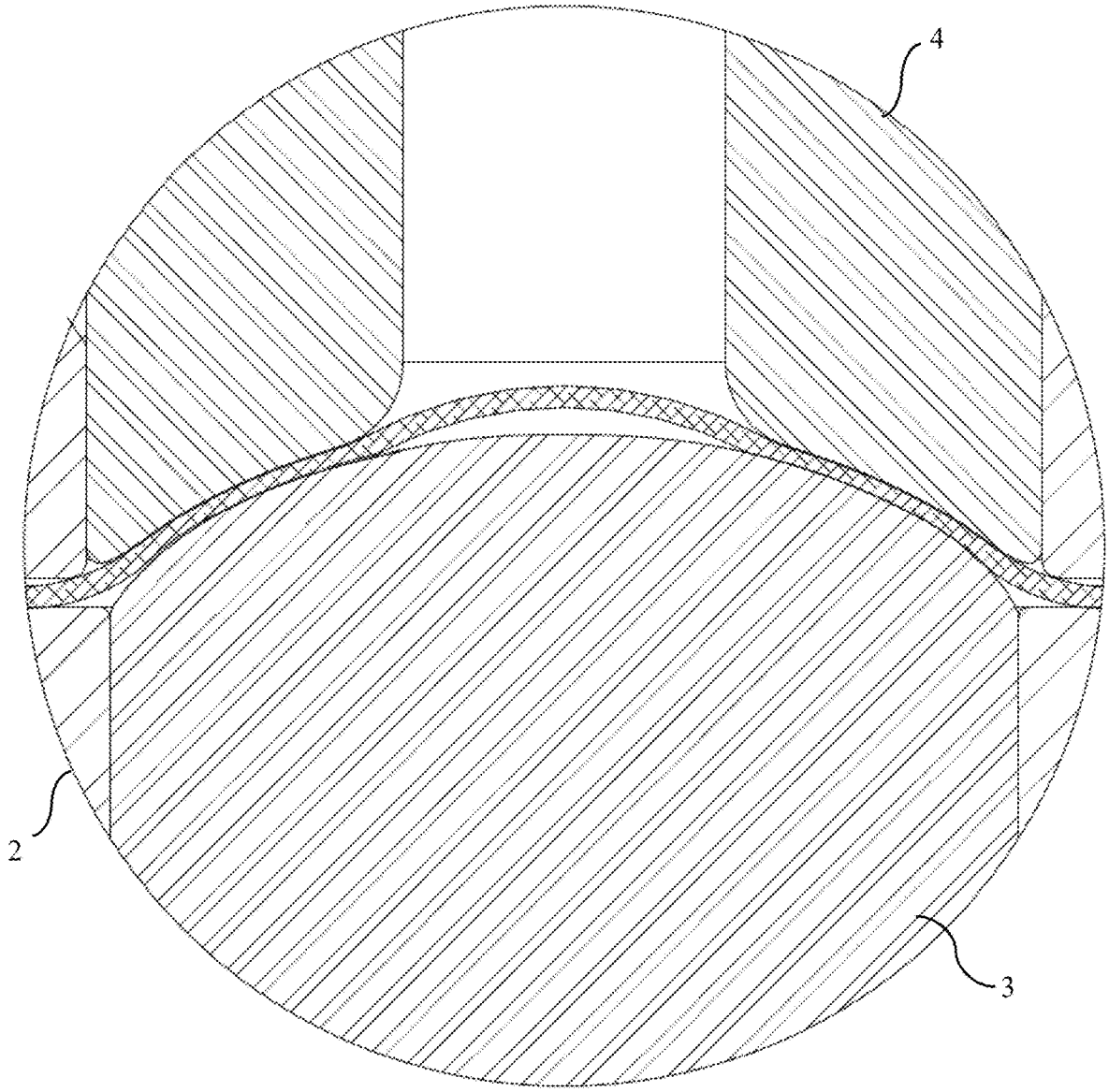
Figure 1 (Prior Art)
FIG. 1 is a schematic cross-sectional side view of selected press elements according to the prior art.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

Clock positions used herein, such as, for example, a 7:00 o'clock position and an 11 o'clock position relate to the orientation of the elements shown in the drawings. That is, when viewed from above, a vertical line evenly bisecting a can end passes through a 12:00 o'clock position and a 6:00 o'clock position, while a horizontal line evenly bisecting a can end passes through a 3:00 o'clock position and a 9:00 o'clock position.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled"

means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly(ies) is resting on a second element(s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "path of travel" or "path," when used in association with an element that moves, includes the space an element moves through when in motion. As such, any element that moves inherently has a "path of travel" or "path." Further, a "path of travel" or "path" relates to a motion of one identifiable construct as a whole relative to another object. For example, assuming a perfectly smooth road, a rotating wheel (an identifiable construct) on an automobile generally does not move relative to the body (another object) of the automobile. That is, the wheel, as a whole, does not change its position relative to, for example, the adjacent fender. Thus, a rotating wheel does not have a "path of travel" or "path" relative to the body of the automobile. Conversely, the air inlet valve on that wheel (an identifiable construct) does have a "path of travel" or "path" relative to the body of the automobile. That is, while the wheel rotates and is in motion, the air inlet valve, as a whole, moves relative to the body of the automobile.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "temporarily coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality). That is, for example, the phrase "a number of elements" means one element or a plurality of elements.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can.

As used herein, a "product side" means the side of a construct used in a container that contacts, or could contact, a product such as, but not limited to, a food or beverage. That is, the "product side" of the construct is the side of the construct that, eventually, defines the interior of a container.

As used herein, a "customer side" means the side of a construct used in a container that does not contact, or could not contact, a product such as, but not limited to, a food or beverage. That is, the "customer side" of the construct is the side of the construct that, eventually, defines the exterior of a container.

As used herein, "generally curvilinear" includes elements having multiple curved portions, combinations of curved portions and planar portions, and a plurality of planar portions or segments disposed at angles relative to each other thereby forming a curve.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and/or near relevant to the term being modified as would be understood by one of ordinary skill in the art.

Materials of lower formability, as described herein, refers to materials having relatively lower formability compared to Aluminum 5182. In an exemplary embodiment, the embodiment is an aluminum alloy. In a further exemplary embodiment, the aluminum alloy contains 0.5 to 1.4% manganese (Mn) by mass, 2.0 to 4.5% magnesium (Mg) by mass, less than 0.6% silicon (Si) by mass, less than 0.8% iron (Fe) by mass, less than 0.10% chromium (Cr) by mass, less than 0.25% zinc (Zn) by mass, less than 0.10% titanium (Ti) by mass, and/or less than 0.25% copper (Cu) by mass.

Relieved Bubble

The bubble station is or may be the first step in the development of a can end. By changing the dimensions of a typical or prior art can end, for example at particular locations and/or by a particular amount, the presently disclosed technology makes it possible and/or easier to use materials of lower formability and/or less expense to create a can end that meets performance requirements.

The following description provides for forming a relieved bubble 12 on a blank 10 or a shell 20. As shown in FIGS. 2-5, the blank 10 is formed into a shell 20 and then into a can end 30. As the blank 10 is formed into a can end 30, the bubble 12' is formed into a rivet button 22 and then, when the rivet button 22 is staked, (thereby coupling a tab to the shell 20) a rivet 32.

Figure 2:
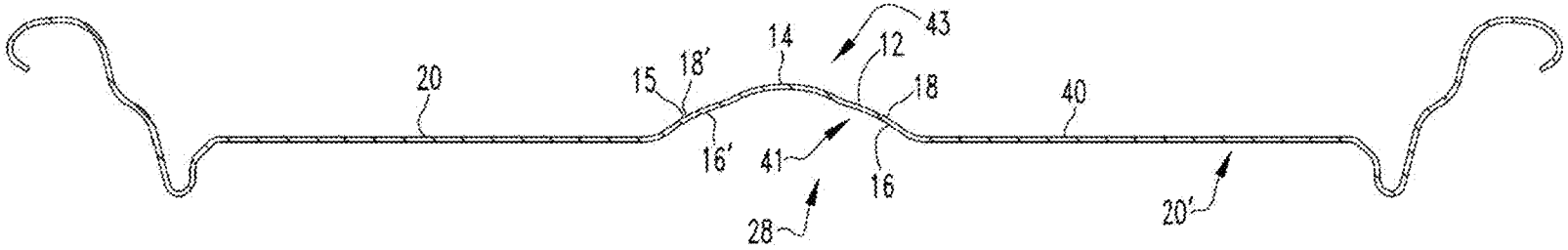
Figure 2 (Prior Art)
FIG. 2 is a cross-sectional view of a shell with a bubble according to the prior art.

The following discussion and the Figures use a generally cylindrical can end 30, FIG. 2, as an example. It is understood that the disclosed and claimed concept is operable with can ends 30 of any shape and the cylindrical shape discussed and shown is exemplary only. Further, in an exemplary embodiment and for the dimensions described below, the can end 30 is made from aluminum or aluminum alloys and is structured to be coupled to a beverage can; that is, a can structured to contain a beverage such as beer or carbonated beverages, i.e., a "soda" or "pop." As used herein, such can end 30 is identified as a "beverage container can end" 30'. Similarly, the shell that becomes a "beverage container can end" 30' is, as used herein, a "beverage can shell" 20'. One non-limiting example of a beverage can having a beverage container can end 30' is a twelve ounce beverage can 30. It is understood, however, that the concept disclosed below is also applicable to can ends made of other materials such as, but not limited to, steel and steel alloys.

Figure 3:
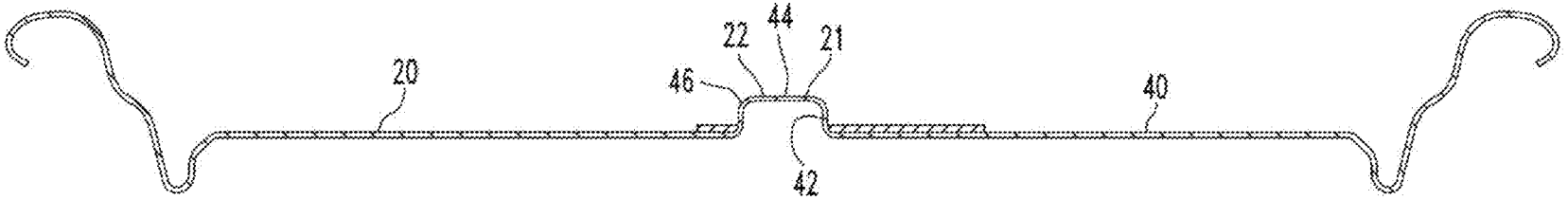
Figure 3 (Prior Art)
FIG. 3 a cross-sectional view of a shell with a rivet button prior to staking according to the prior art.

As is generally known, a can end 30 is structured to be, and is, coupled, directly coupled, or fixed in a sealed manner to a can body (not shown) to form a container (not shown). The can end 30 includes a generally planar central panel 40, discussed below, and the rivet 32, as defined below. The rivet 32 is formed from a rivet button 22 (FIG. 3). That is, a rivet button 22 protrudes upwardly, as shown, from the central panel 40 and includes a sidewall 42 and a generally rounded top portion 44. The terms sidewall 42 and top portion 44 describe the same elements of both the rivet 32 and the rivet button 22 and the same names/reference numbers are used to describe these common elements. Further, while the bubble 12' does not include a perpendicular sidewall and planar top portion, it is understood that portions of the bubble 12' substantially become the rivet button sidewall 42 and top portion 44 with a transition portion 46 therebetween. The rivet button transition portion 46 has a radius of about 0.014 inch, when viewed in cross-section, as shown. That is, the bubble 12' includes a perimeter 41 and a rivet portion 43. Further, as described below, the perimeter 41, which is substantially the area extending about, i.e., around, the rivet portion 43, is one of either an enhanced coined periphery 16 or an expanded coined periphery 18, as defined above. The rivet portion 43 is formed into the rivet button sidewall 42 and top portion 44, as described below.

Further, the central panel 40 disposed about the rivet 32 generally exists in both the blank 10 and the shell 20 and, therefore, is identified as the central panel 40 at all stages of forming the can end 30. Generally, the central panel 40 is planar but may include formations such as, but not limited to, a recess disposed about a tab 50. In an exemplary embodiment, the central panel 40 is made from aluminum and is sized for a beverage container. As used herein, "sized for a beverage container" means sized for a twelve fluid ounce beverage container of a standard size used for "soda," "pop," or beer, which is well known in the art.

A shell 20 is converted to a can end 30 when a tab 50 is coupled thereto. The tab 50 includes an elongated body 52 defining an opening 54. The tab body opening 54 is disposed about a rivet button 22, i.e., the rivet button 22 extends through the tab body opening 54. Then the rivet button 22 is deformed, i.e., generally flattened, thereby forming the rivet 32. The deformation of the rivet button 22 increases the radius/diameter of the rivet 32 so that the rivet 32 has an "enhanced overlap" of a tab body 52. Generally, the deformation of the rivet button 22 deforms the rivet button sidewall 42 causing the rivet button sidewall 42 to buckle outwardly. Further, as used herein, a rivet 32 inherently has a deformed sidewall 42. That is, the expanded rivet deformed sidewall 42 is the rivet button sidewall 42 after deformation. Accordingly, the rivet deformed sidewall 42 and the rivet button sidewall 42 share the same reference number.

As the blank 10 is formed into a can end 30, a bubble 12' shown in FIG. 2 is formed. That is, a shell 20 (or the sheet material or the blank 10) includes a bubble portion 28 which is the portion of the central panel 40 that will be formed into a bubble 12'. The bubble 12 includes a head 14 and a periphery 15 disposed thereabout. As discussed below, the press 500 used to form a can end 30 includes a bubble station upper punch 602 and a generally opposing bubble station lower punch 606. The forming surface of the bubble station upper punch, i.e., the first bubble coining surface 624 (discussed below) is generally toroid, i.e., ring shaped. Thus, during the forming process, a portion of the bubble 12' is not disposed between two forming surfaces. The portion of the bubble 12' that is not disposed between two forming surfaces is the bubble head 14. Generally, the bubble head 14 is subsequently formed into the rivet portion 43.

Further, during the formation of the bubble 12', the portion of the shell 20 disposed between the bubble station upper punch 602, i.e., the bubble station upper punch body 603, and the opposing bubble station lower punch 606, i.e., the bubble station lower punch body 607, is coined. As used herein, to "coin" means to simultaneously engage opposing sides of the shell 20 and induce plastic flow on the surface of the material. As is known, coining material work hardens the surface(s), while the material therebetween retains its toughness and ductility. The portion of the bubble 12' disposed about, i.e., around, the periphery 15, and in an exemplary embodiment, the portion immediately about the rivet portion 43, is coined and is one of either an enhanced coined periphery 16 or an expanded coined periphery 18. That is, the perimeter 41 is formed as one of either an enhanced coined periphery 16 or an expanded coined periphery 18. In an exemplary embodiment, when the can end 30 is a beverage container can end 30', the enhanced coined periphery 16 is a beverage can enhanced coined periphery 16', or, the expanded coined periphery 18 is a beverage can expanded coined periphery 18'.

Figure 6:
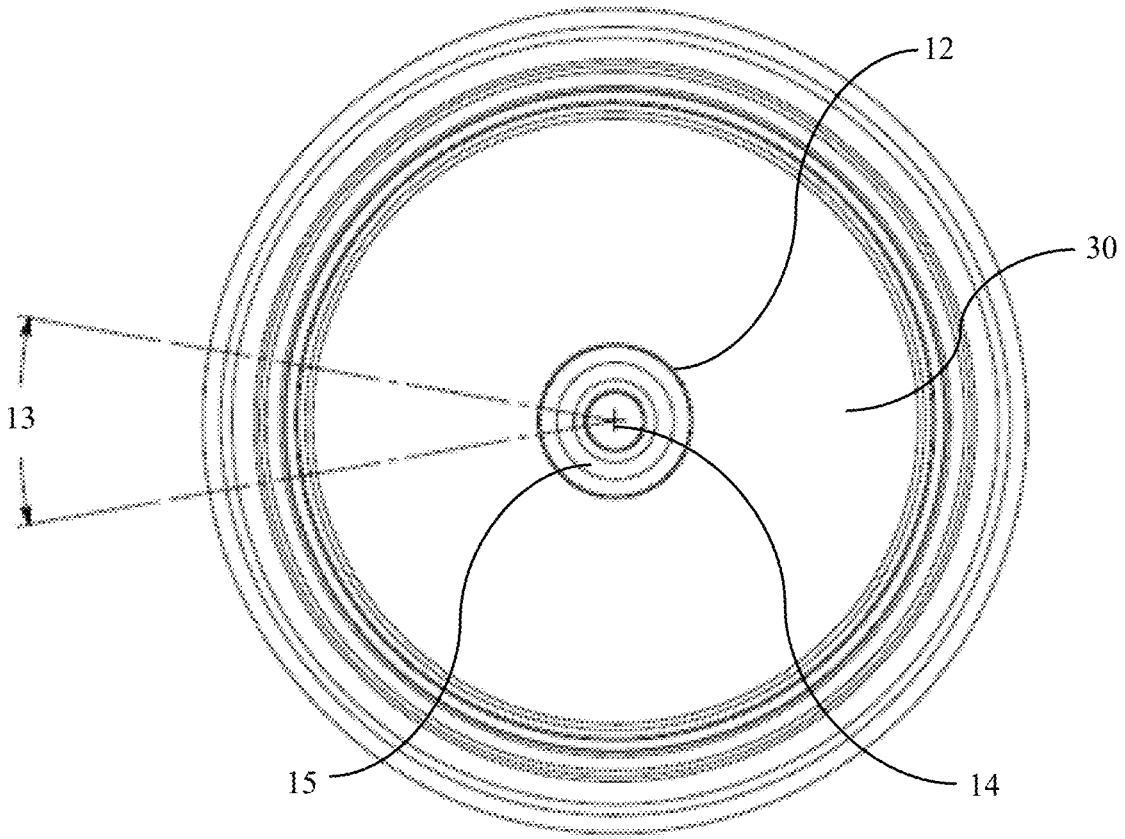
FIG. 6 is a top down view of a shell with a relieved bubble according to one embodiment of the presently disclosed technology.
Figure 8A:
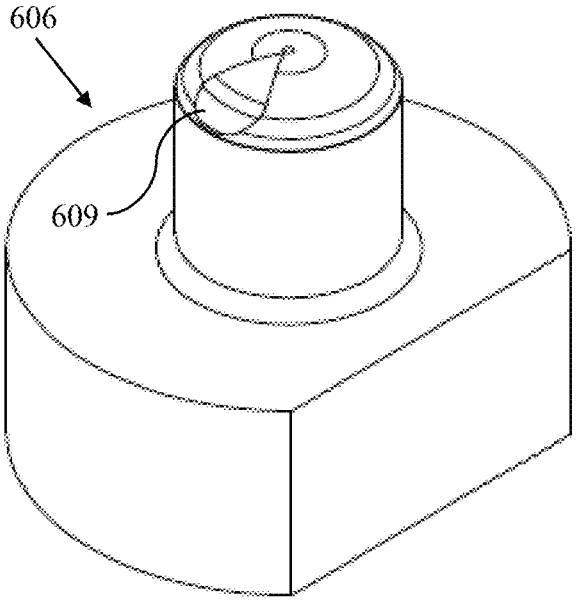
FIG. 8A is a perspective view of a lower punch of a bubble station lower tooling assembly according to one embodiment of the presently disclosed technology.
Figure 8B:
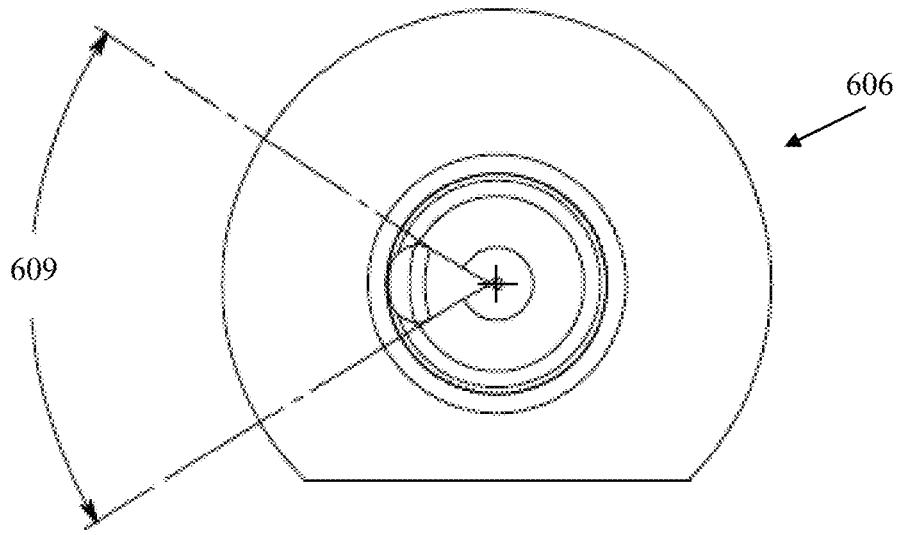
FIG. 8B is a top down view of a lower punch of a bubble station lower tooling assembly according to one embodiment of the presently disclosed technology.

In one optional embodiment, as shown in FIG. 6, the relieved bubble 12 includes a relieved portion 13 around a perimeter thereof. The remaining portion of the relieved bubble 12 is the non-relieved portion. This is in contrast to the prior art, where the relieved bubble 12 is consistent, symmetric, and/or smooth around the top and/or circumference of the insert. In an exemplary embodiment, the relieved portion 13 is less than 30% of the area of the periphery. In a further exemplary embodiment, the relieved portion 13 is approximately 25%, or exactly 25%, of the area of the periphery. In an exemplary embodiment as shown in FIG. 8B, the relieved portion 13 is defined between the 7:00 o'clock position and the 11:00 o'clock position when viewed from above, though other positions are possible. As such, when the relieved bubble 12 is formed, coining will be prevented or at least reduced at the area of the relieved portion, in turn defining a greater relative material thickness and a lower risk of tearing at that location. Thus, the positioning of the relieved portion 13 defines a specific location at which the risk of tearing is eliminated or reduced. In the exemplary embodiment, the relieved portion is a smaller portion of the relieved bubble than the non-relieved portion.

The relieved portion 13 is formed as a result of an upper relief area on the upper insert and/or a lower relief area 609 (see, e.g., FIGS. 8A and 8B) on the bubble station lower punch 606. In an exemplary embodiment, the lower relief area 609 is defined on the bubble station lower punch 606. The defining of the relief area 609 on the bubble station upper punch and/or the bubble station lower punch 606 renders the respective punch asymmetrical. The non-relieved portion is subjected to coining between a first bubble coining surface on the bubble station upper punch and a second bubble coining surface on the bubble station lower punch 606. In operation, upper relief area and/or lower relief area 609 subject the relieved portion 13 of the relieved bubble 12 to a less degree of pressure, thus allowing the relieved portion 13 to remain thicker and softer.

In one embodiment, the amount of relief is dependent on the amount of tear resistance needed to provide an acceptable finished product. These factors may include, but are not limited to material hardness, material formability, and tooling in the rest of the beer/beverage progressive die.

Figure 4:
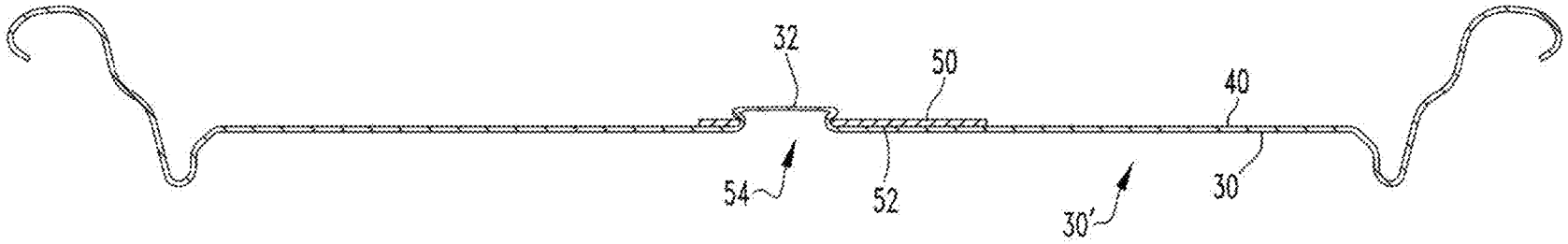
Figure 4 (Prior Art)
FIG. 4 is a cross-sectional view of a can end with a staked rivet according to the prior art.

As noted above, the shell 20 is, initially, a blank 10 cut from a sheet of generally planar material such as, but not limited to aluminum, steel, or alloys of either. That is, in an exemplary embodiment, the sheet 1 of generally planar material (hereinafter, "sheet material") is provided to a press 500, shown schematically FIG. 5, such as a conversion press, that is structured to, and does, form the sheet material into a can end 30 (FIG. 4). Alternatively, the sheet material is only formed into a shell 20 in a shell press (not shown).

Figure 5:
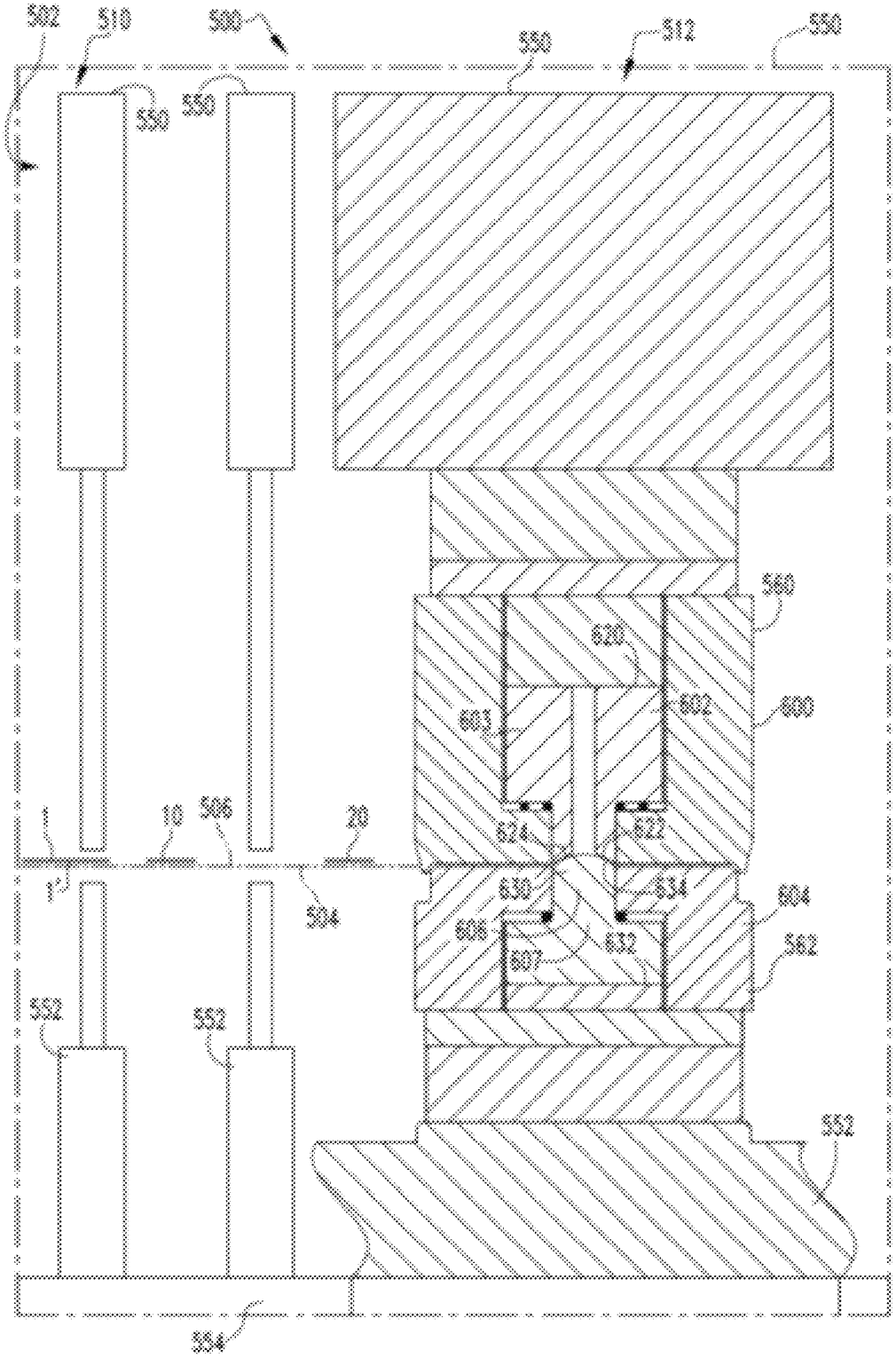
Figure 5 (Prior Art)
FIG. 5 is a schematic cross-sectional view of a press according to the prior art.
Figure 15A:
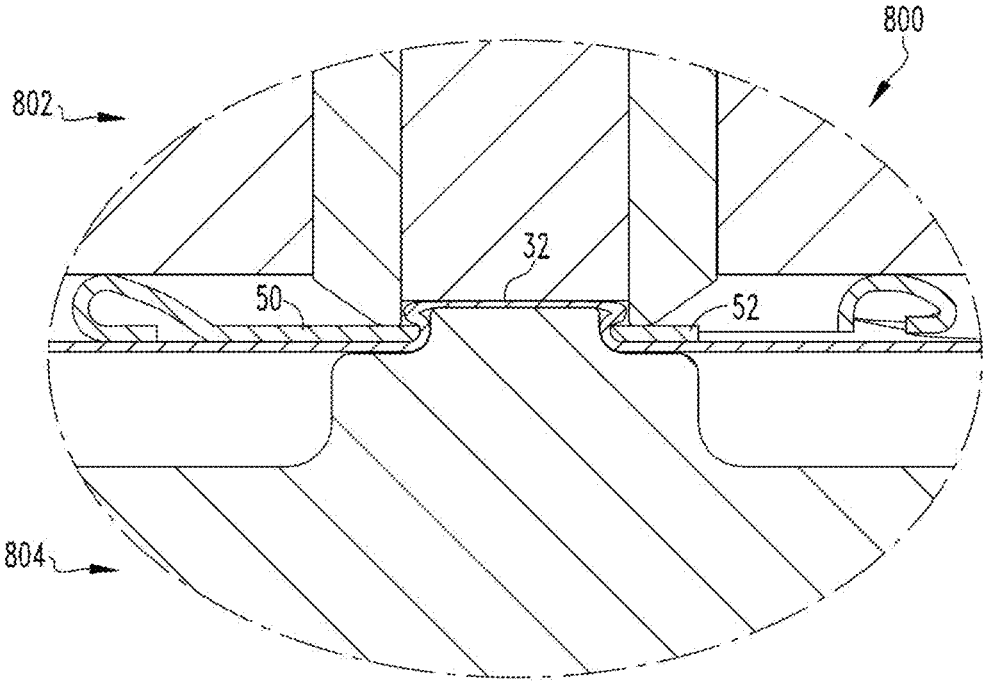
FIG. 15A is a detail, schematic cross-sectional view of a staking station.
Figure 15B:
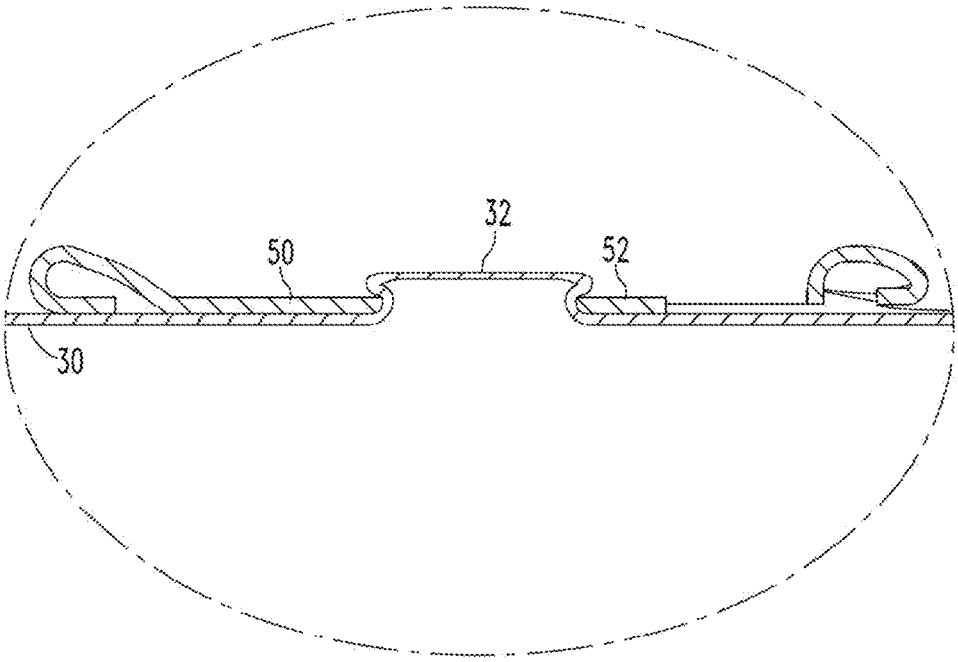
FIG. 15B is a detail, schematic cross-sectional view of a rivet.

As shown in FIG. 5, the press 500 includes a number of stations 502 (some shown schematically) each of which perform a number of forming operations on the shell 20 (as shown in the Figures, stations are generically identified by reference number 502). For the purpose of this application, the following stations 502 are identified: a bubble station 512 (FIG. 7A), a first rivet station 514 (FIG. 9A), a second rivet station 516 (FIG. 12A), and a stake station 518 (FIG. 15A). One of the first forming operations includes cutting the blank 10 from the sheet material; thus, there is a blanking station, not shown. As is known, other forming operations form the blank 10 so as to have a countersink, a chuck wall and other elements of a shell 20. It is understood, however, that the relieved bubble 12 can be formed at any time prior to forming a rivet, including before the blank 10 is cut from the sheet material. Thus, the forming operations that form the relieved bubble 12 can be performed on any of the sheet material, the blank 10, or the shell 20. Generally, the discussion below will use the shell 20 as a non-limiting example of a work piece being formed.

The blank 10/shell 20 moves through the conversion press 500 on a conveyor 504, shown schematically in FIG. 5, that is structured to, and does, move with an intermittent, or indexed, motion. In an exemplary embodiment, the conveyor 504 is a belt 506 (shown schematically) including a number of recesses, not shown. The belt 506 moves a set distance then stops before moving the set distance again. As the belt 506 moves, a blank 10/shell 20 is moved sequentially through the conversion press number of stations 502 where, as noted above, each station 502 performs a single forming operation, or a number of forming operations, on the blank 10/shell 20.

The conversion press 500, or stated alternately each station 502 thereof, includes an upper tooling assembly 550 and a lower tooling assembly 552. Each of the upper tooling assembly 550 and a lower tooling assembly 552 for multiple stations 502 are, in an exemplary embodiment, unitary or coupled and support the dies, punches and other elements of each station. In this configuration, the upper tooling assemblies 550 for the stations move at the same time and are driven by a single drive assembly (not shown). For the purpose of identifying specific components, elements of a tooling assembly are also identified as parts of a specific station 502. That is, for example, the upper tooling assembly 550 at the bubble station 512, discussed below, is also identified as the bubble station upper tooling assembly 560. It is understood that any specifically identified upper tooling assembly 550 or lower tooling assembly 552, e.g., a "rivet station upper tooling assembly 700," are generally part of the upper/lower tooling assemblies 550/552, respectively, and the identifier/name merely indicates the nature of the station.

The conversion press 500 further includes a frame 554 and a drive assembly, not shown. In an exemplary embodiment, the lower tooling assembly 552 is fixed to the frame 554 and is substantially stationary. The upper tooling assembly 550 is movably coupled to the frame 554 and is structured to move between a first position, wherein the upper tooling assembly 550 is spaced from the lower tooling assembly 552, and a second position, wherein the upper tooling assembly 550 is closer to, and in an exemplary embodiment, immediately adjacent, the lower tooling assembly 552. The lower tooling assembly 552 is, in an exemplary embodiment, coupled, directly coupled, or fixed to the frame 554.

It is understood that, generally, the belt 506 moves when the upper tooling assembly 550 is in (or moving toward or away from) the first position. Conversely, the belt 506 is stationary when the upper tooling assembly 550 is in the second position. As is known, the drive assembly is structured to, and does, move the upper tooling assembly 550 between the first and second positions. Further, and as is known, the upper tooling assembly 550 and the lower tooling assembly 552 include separately movable elements, e.g., punches, dies, spacers, pads, risers and other sub-elements (collectively hereinafter "sub-elements"), that are structured to, and do, move separately from each other. All elements, however, generally move with the upper tooling assembly 550 between first and second positions. That is, generally, the motions of the sub-elements are relative to each other but as a whole, the upper tooling assembly 550 moves between the first position and the second position as described above. Further, it is understood that the drive assembly includes cams, linkages, and other elements that are structured to move the sub-elements of the upper tooling assembly 550 and the lower tooling assembly 552 in the proper order. That is, selected sub-elements of the upper tooling assembly 550 and the lower tooling assembly 552 are structured to move independently of other selected sub-elements. For example, one selected sub-element is structured to move into, and dwell, at the second position while another sub-element moves into and out of the second position. Such selective motion of the sub-elements is known in the art.

In an exemplary embodiment, the bubble station 512 includes a bubble station upper tooling assembly 560 and a bubble station lower tooling assembly 562. The bubble station upper tooling assembly 560 includes an upper cap 600 and an upper punch 602. The bubble station lower tooling assembly 562 includes a lower cap 604 and a lower punch 606. The bubble station upper cap 600 and the bubble station upper punch 602 are coupled, directly coupled, or fixed to a bubble station upper tooling assembly 550. The bubble station lower cap 604 and the bubble station lower punch 606 are coupled, directly coupled, or fixed to a bubble station lower tooling assembly 552. In an exemplary embodiment, the bubble station upper cap 600 and the bubble station lower cap 604 are structured to move together prior to the bubble station upper punch 602 and the bubble station lower punch 606 engaging the shell 20. That is, the bubble station upper cap 600 and the bubble station lower cap 604 move together and hold, or clamp, the shell at the central panel 40. As used herein, to "hold" an element being formed means that the material being held is drawn or ironed, i.e., the metal flows, between the constructs "holding" the element. The act of drawing/ironing the material may thin the material. As used herein, to "clamp" an element being formed means that the material being clamped is substantially fixed between the constructs "clamping" the element. Thus, when a formation that increases the surface area of the element being formed occurs on a clamped element, the material is stretched and thinned as opposed to being drawn and thinned. In one exemplary embodiment, the bubble station upper cap 600 and the bubble station lower cap 604 are structured to, and do, hold the sheet material/the blank 10/the shell 20. In another exemplary embodiment, the bubble station upper cap 600 and the bubble station lower cap 604 are structured to, and do, clamp the sheet material/the blank 10/the shell 20. After the bubble station upper cap 600 and the bubble station lower cap 604 move together, the bubble station lower punch 606 engages the shell forming an initial bubble. Thereafter, or at about the same time, the bubble station upper punch 602 moves to a coining distance from the bubble station lower punch 606. As used herein, a "coining distance" is a distance between two surfaces sufficiently close so as to coin material disposed between the two surfaces.

That is, the bubble station upper punch 602 includes a body 603 with an upper end 620 and a lower end 622. As shown, the bubble station upper punch body 603 is a hollow, generally cylindrical body. The bubble station upper punch body lower end 622 defines a first bubble coining surface 624. As used herein, a "coining surface" means a surface structured to coin a metal. Stated alternately, a coining surface 624 is disposed on the bubble station upper punch body lower end 622. The bubble station lower punch 606 also includes a body 607 with an upper end 630 and a lower end 632. The bubble station lower punch body upper end 630 defines a second bubble coining surface 634. That is, the portion of the bubble station lower punch body upper end 630 that is disposed in opposition to the first bubble coining surface 624 is the second bubble coining surface 634.

In operation, the first bubble coining surface 624 is structured to move between a first position, wherein the first bubble coining surface 624 is spaced from the second bubble coining surface 634, and a second position, wherein the first bubble coining surface 624 is a coining distance from the second bubble coining surface 634. Thus, the first bubble coining surface 624 and the second bubble coining surface 634 are structured to engage the bubble portion 28 of a sheet material disposed between the first bubble coining surface 624 and the second bubble coining surface 634. In this configuration, when the first bubble coining surface 624 and the second bubble coining surface 634 are in the second position, the first bubble coining surface 624 and the second coining bubble surface 634 form a relieved bubble, as described above. That is, the bubble station upper tooling assembly 560, or the bubble station upper punch 602, is structured to move between a first position, wherein the bubble station upper tooling assembly 560 is spaced from the bubble station lower tooling assembly 562 (and elements thereof including, but not limited to, the bubble station lower punch 606), and a second position wherein the bubble station upper tooling assembly 560 is immediately adjacent the bubble station lower tooling assembly 562 (and elements thereof including, but not limited to, the bubble station lower punch 606).

Figure 7A:
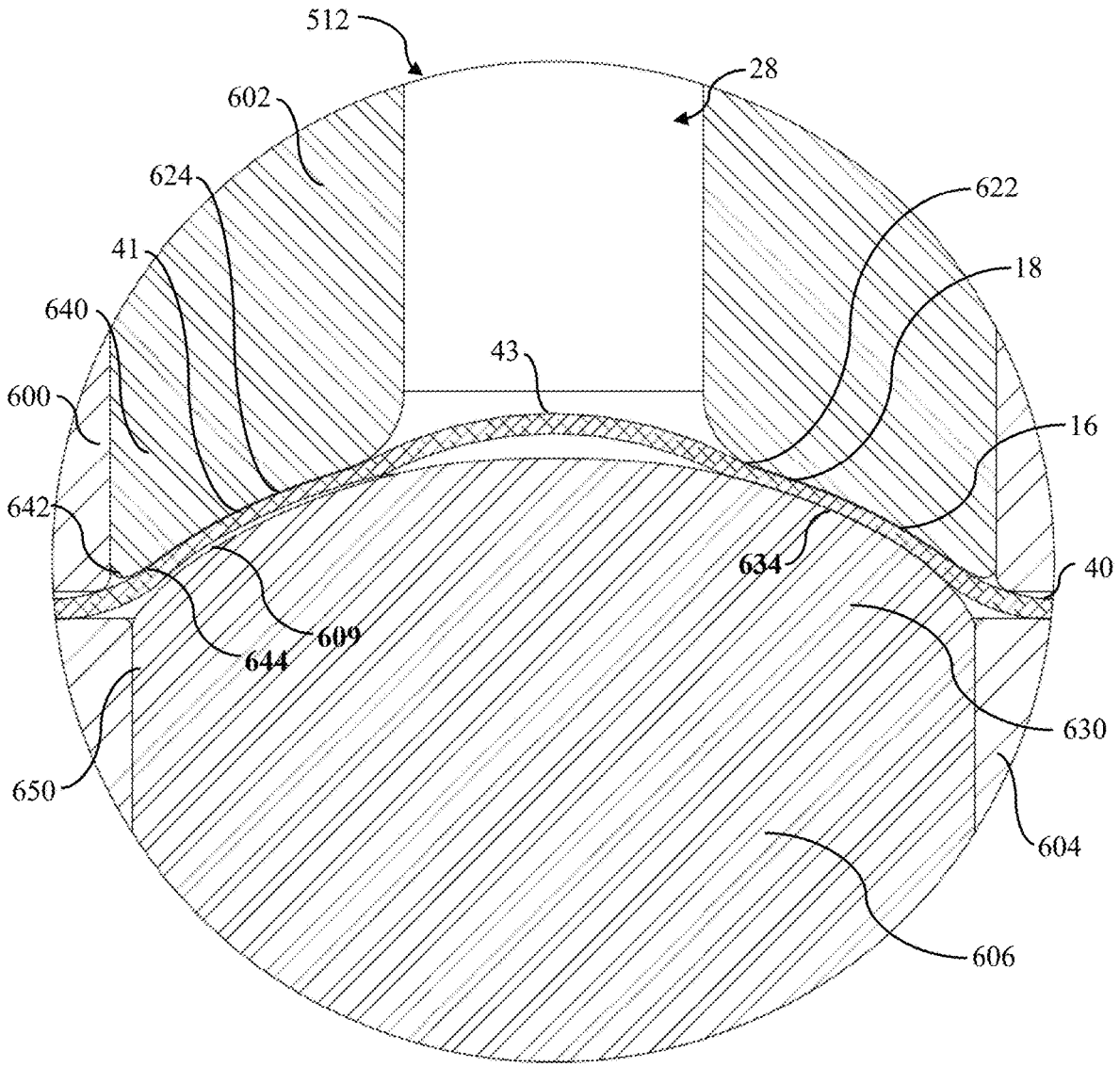
FIG. 7A is a detail, schematic cross-sectional view of a bubble station according to one embodiment of the presently disclosed technology.
Figure 7B:
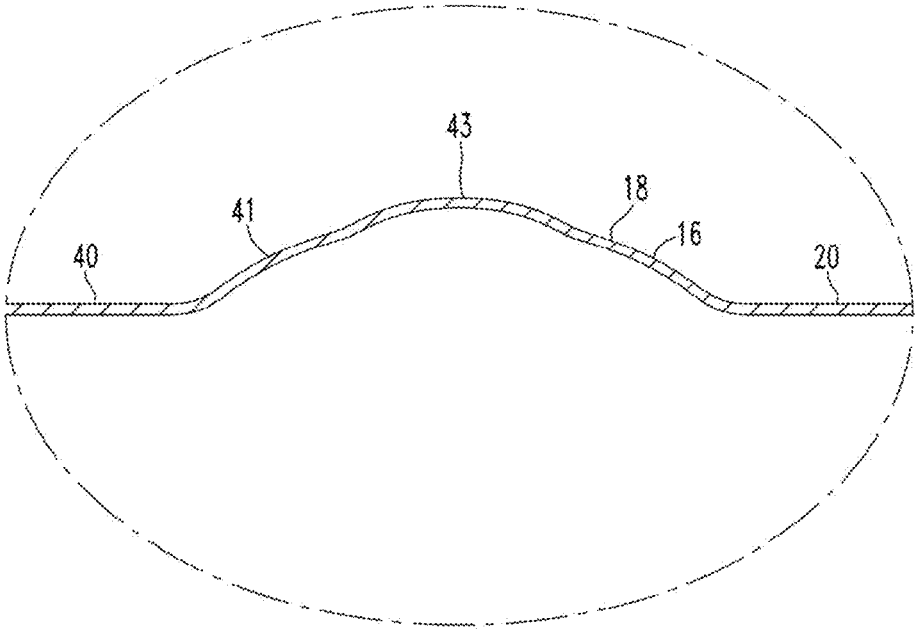
FIG. 7B is a detail, schematic cross-sectional view of a relieved bubble on a shell according to one embodiment of the presently disclosed technology.

In an exemplary embodiment, the bubble station upper punch body lower end 622 includes a partially rounded peripheral portion 640. The bubble station upper punch body lower end peripheral portion 640, when viewed in cross-section as shown in FIG. 7A, includes an outer end 642 and an inner end 644. The bubble station upper punch body lower end peripheral portion inner end 644 has a radius. Again, it is noted that in an exemplary embodiment, the can end 30 is generally circular and therefore the tooling is also generally circular. It is understood that the bubble station upper punch body lower end peripheral portion inner end 644 "radius" is measured from the center of a generally circular bubble station upper punch body lower end 622. It is further understood that if the bubble station upper punch body lower end 622 was not circular, the "radius" would be measured as a corresponding cross-sectional line. That is, for example, if the bubble station upper punch body lower end 622 was generally rectangular, the "radius" would be one half of a line extending laterally over the rectangular upper punch body lower end 622.

The bubble station lower tooling assembly lower cap 604 includes an inner radial surface 650. The bubble station lower tooling assembly lower cap inner radial surface 650 has a radius. The bubble station upper punch body lower end peripheral portion inner end 644 radius is greater than the bubble station lower tooling assembly lower cap inner radial surface 650 radius.

Further, in an exemplary embodiment, the press 500 has a bubble station lower punch 606 diameter/height ratio of between about 5.0:1 to about 8.0:1, or, a diameter/height ratio of between about 5.0:1 to about 5.3:1, or, about 5.11:1, and, a rivet station upper punch coining surface length/diameter ratio of between about 0.3:1 to 0.6:1, or about 0.315:1. Further, in an exemplary embodiment, the press 500, i.e., the bubble station upper punch 602 and the bubble station lower punch 606 have a bubble station upper punch coining surface length/diameter ratio of about 0.315:1 and a bubble station lower punch diameter/height ratio of about 5.11:1. It is noted that, generally, when the sheet material is thinner (relative to a different sheet material) the bubble station upper punch diameter (A) and the coining surface length are increased.

Thus, as used herein, a "standard beverage can press" has a bubble station lower punch diameter/height ratio of 5.38:1 and a bubble station upper punch coining surface length/diameter ratio of 0.283:1. Such tooling forms, as used herein, a "standard bubble." A bubble station 512, i.e., a bubble station upper punch 602 and a bubble station lower punch 606, having a "bubble contour," as defined above, has a contour that is different than a "standard bubble" and is, as used herein, a "non-standard bubble."

Further, in an exemplary embodiment, the bubble station upper tooling assembly 560 and the bubble station lower tooling assembly 562, or the bubble station upper punch 602 and the bubble station lower punch 606, are structured to operate together to form a relieved bubble 12 as defined above. That is, the bubble station upper tooling assembly 560 and the bubble station lower tooling assembly 562, or the bubble station upper punch 602 and the bubble station lower punch 606, are structured to form a relieved bubble 12 with a bubble head 14 wherein the bubble head 14 has a thickness of between about 0.0073 inch and 0.0079 inch, or about 0.0076 inch. Further, the bubble station upper tooling assembly 560 and the bubble station lower tooling assembly 562, or the bubble station upper punch 602 and the bubble station lower punch 606, are structured to form a relieved bubble 12 with a height of between about 0.0840 inch and about 0.0880 inch, or about 0.0859 inch.

Tooling in this configuration is structured to form a relieved bubble 12 and, as such, solves the problems noted above.

Accordingly, a method of forming a shell 20 with a relieved bubble 12 includes, providing a sheet material with a base thickness, forming the sheet material into a shell 20, forming a relieved bubble 12 on the shell 20, and performing finishing operations on the shell 20. As used herein, "finishing operations" include, but are not limited to, scoring the shell 20 or can end 30, paneling the shell 20 or can end 30, inspection of the shell 20 or can end 30, or applying coatings and/or other surface treatments to the shell 20 or can end 30.

In an exemplary embodiment, forming a relieved bubble 12 on the shell 20 includes forming the relieved bubble 12 with a bubble head 14, forming the bubble head 14 with a thickness of between about 0.0066 inch and 0.0079 inch, and forming the relieved bubble 12 with a height of between about 0.070 inch and about 0.095 inch. Alternately/additionally, forming a relieved bubble 12 on the shell 20 includes forming the relieved bubble head 14 with a thickness of about 0.0076 inch and forming the relieved bubble with a height of about 0.0859 inch.

In an exemplary embodiment, providing a sheet material with a base thickness and forming the sheet material into a shell 20, forming a relieved bubble 12 on the shell 20 further include providing an aluminum sheet, and, forming a beverage container shell 20. In an exemplary embodiment, the providing an aluminum sheet includes providing an aluminum sheet with a base thickness of less than 0.0082 inch. As noted above, in an exemplary embodiment, the base thickness of the aluminum sheet is between about 0.0097 inch and about 0.0060 inch, or about 0.0078 inch. Optionally, the base thickness of the aluminum sheet could be about 0.0092 inch. Further, performing finishing operations on the shell 20 includes forming the relieved bubble into a rivet button, providing a tab with a body, the tab body including a coupling opening, positioning the tab over the rivet button with the rivet button extending through the tab coupling opening, forming the rivet button into a rivet, and wherein the rivet has an enhanced overlap of the tab body. As used herein, an "enhanced overlap" of a tab body 52 means that the deformed rivet sidewall 42 was formed from a rivet button.

Rounded Rivets

The first rivet station and the second rivet station are or may be the second and third steps respectively in the development of a can end. By changing the dimensions of a typical or prior art can end, for example at particular locations and/or by a particular amount, the presently disclosed technology makes it possible and/or easier to use materials of lower formability and/or less expense to create a can end that meets performance requirements.

Figure 9A:
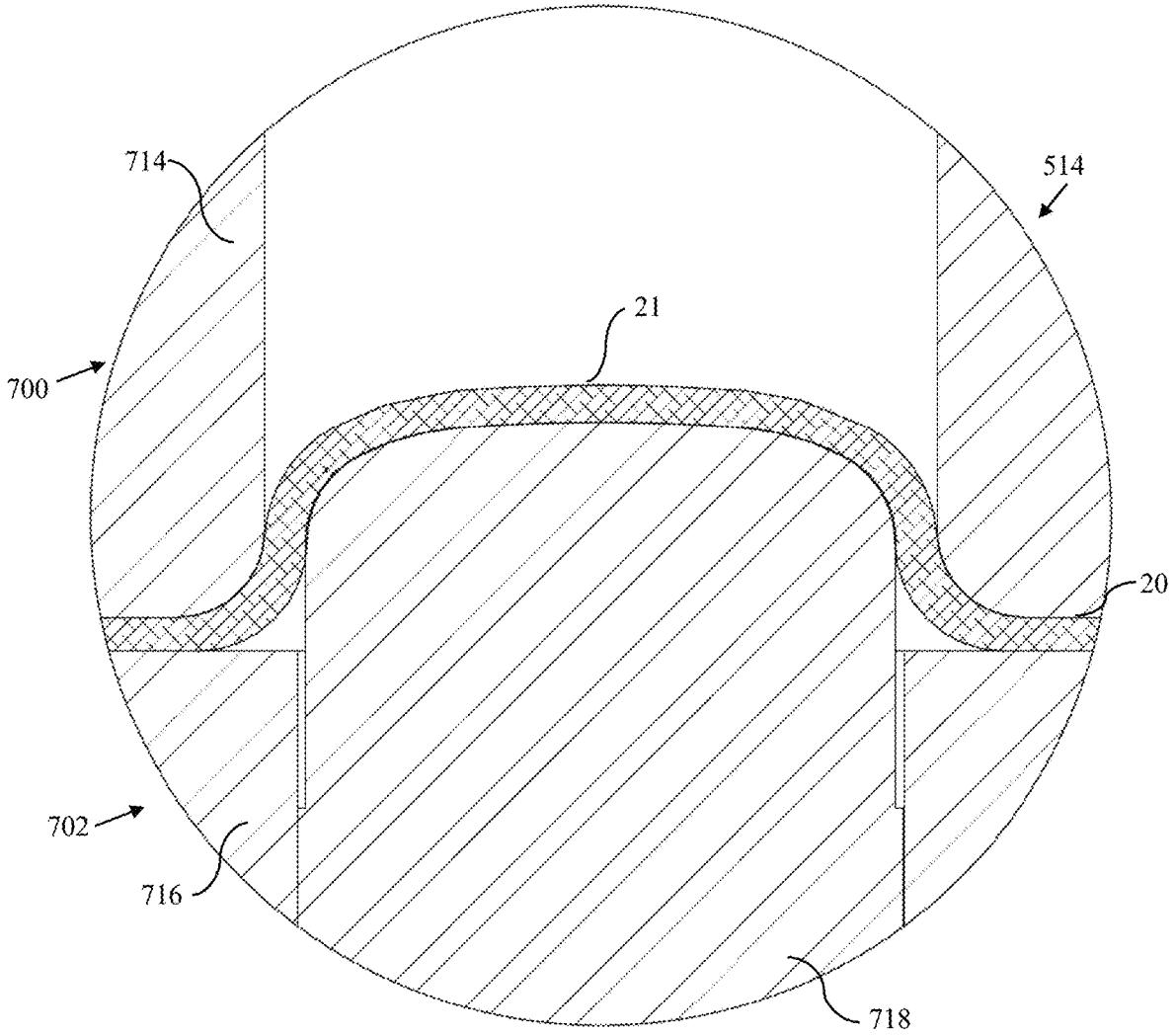
FIG. 9A is a detail, schematic cross-sectional view of a first rivet station according to one embodiment of the presently disclosed technology.
Figure 9B:
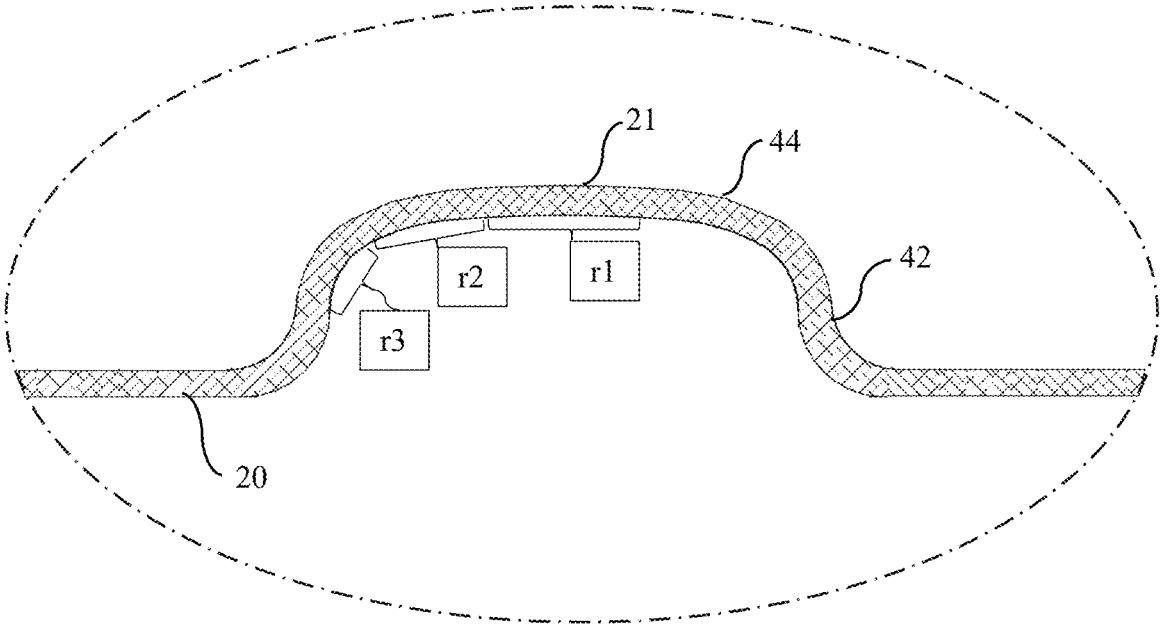
FIG. 9B is a detail, schematic cross-sectional view of a first rivet button on a shell according to one embodiment of the presently disclosed technology.
Figure 12A:
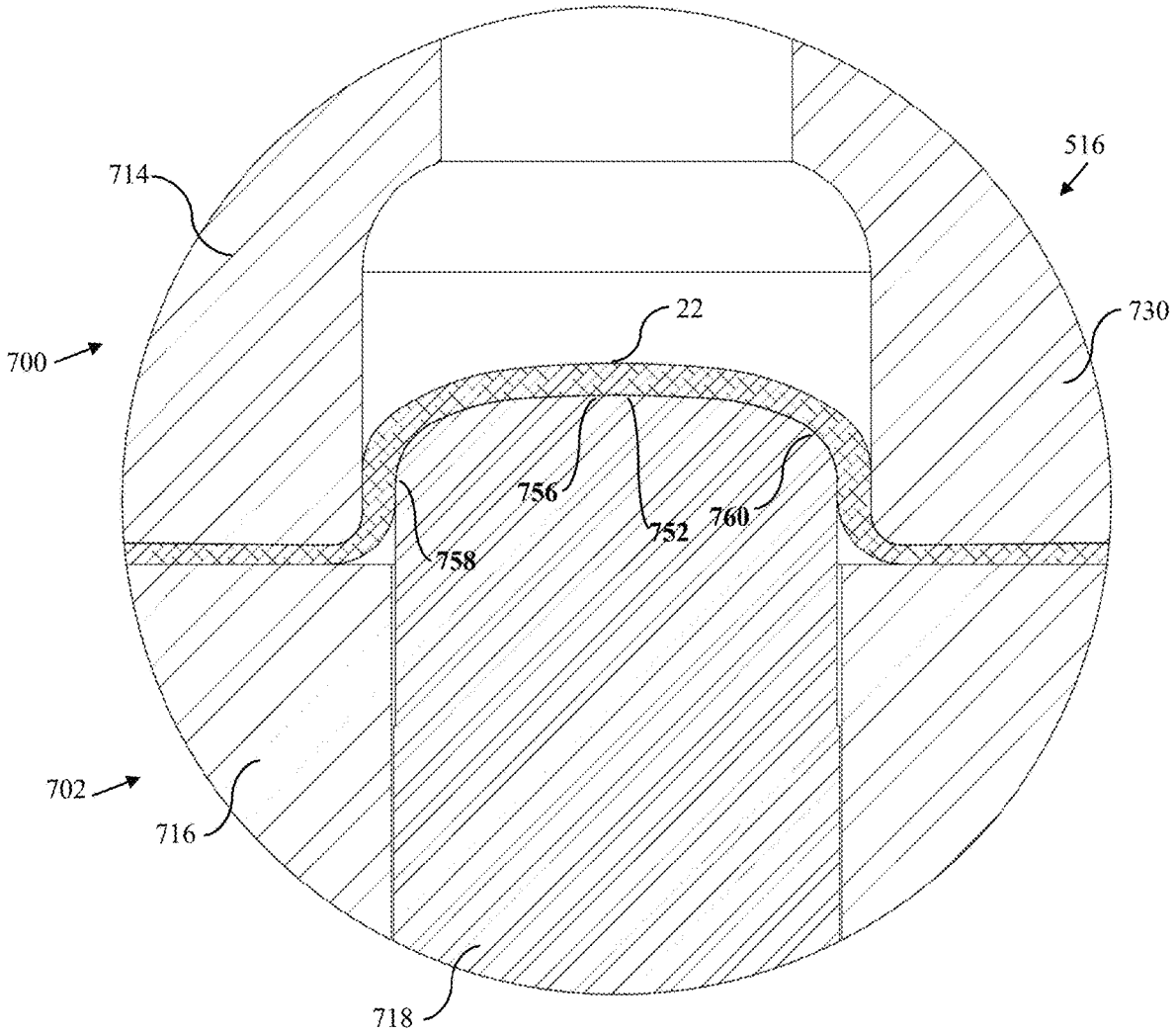
FIG. 12A is a detail, schematic cross-sectional view of a second rivet station according to one embodiment of the presently disclosed technology.
Figure 12B:
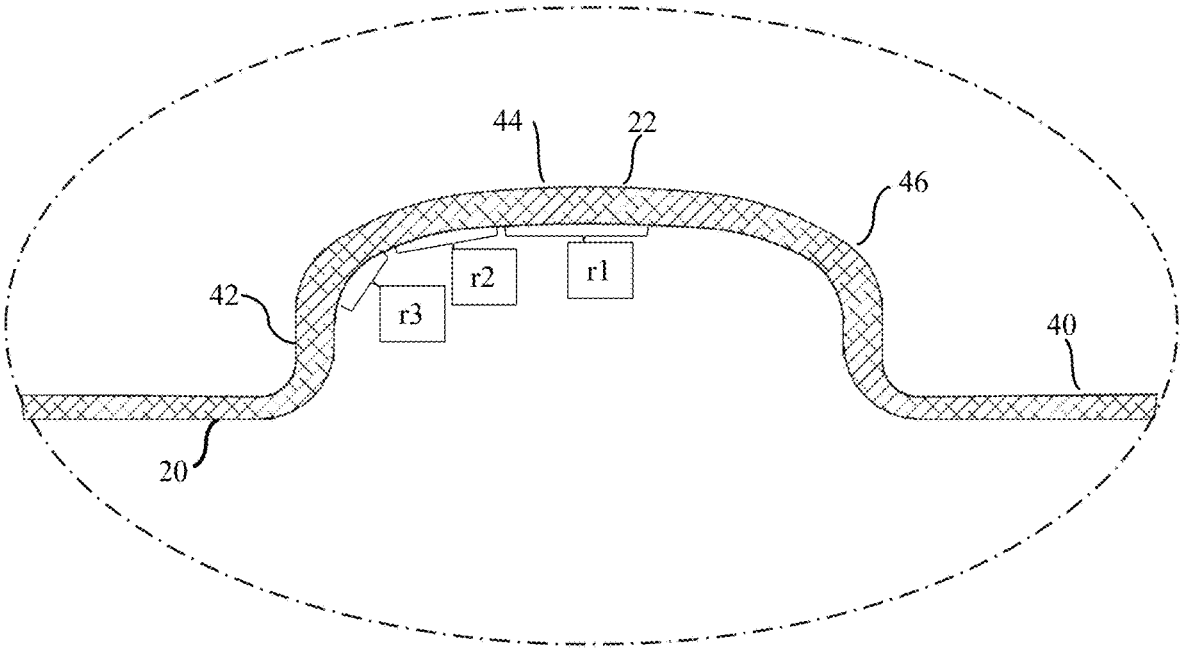
FIG. 12B is a detail, schematic cross-sectional view of a second rivet button on a shell according to one embodiment of the presently disclosed technology.

As noted above, the relieved bubble 12 is formed into a rivet button 22, as shown in FIGS. 9B and 12B. As such, the rivet button 22 is disposed on the central panel 40 wherein the central panel 40 has the same base thickness as the sheet material described above. When formed, as described below, the rivet button 22 includes a generally rounded top portion 44 and a generally cylindrical sidewall 42. As noted above, the rivet portion 43 is formed into the sidewall 42 and the top portion 44. As also noted above, the perimeter 41 is, substantially, either the enhanced coined periphery 16 or the expanded coined periphery 18. A general discussion of the rivet station and riveting process is disclosed in U.S. Pat. No. 11,691,193, which is hereby incorporated by reference. Reference numbers 710, 720, 722, 724, 726, 728, 730, 740, 742, 744, 746, 750, and 754 refer to elements of a rivet tooling assembly which are shown in U.S. Pat. No. 11,691, 193.

As shown in FIGS. 9A and 12A, a rivet button 21, 22 (FIGS. 9B, 12B) is formed from the relieved bubble 12 in a number of rivet stations 514, 516, in the conversion press 500, discussed above. Generally, each of a first and second rivet station 514, 516, respectively, includes a rivet station upper tooling assembly 700 and a rivet station lower tooling assembly 702 (FIG. 9A). Each rivet station upper tooling assembly 700 includes a rivet station upper cap 710 and a rivet station upper punch 714. Each rivet station lower tooling assembly 702 includes a rivet station lower cap 716 and a rivet station lower punch 718.

Generally, the first rivet station 514 forms the relieved bubble 12 into a rivet button 21 having a sidewall 42 and a generally round top portion 44. In an exemplary embodiment, the rivet button transition portion 46 has a greater "radius" than the rivet station lower punch body upper end transition surface 760 (see FIG. 12A), discussed below, and, that the first rivet station upper punch 714 does not extend above a reference plane 746 more than the distance discussed below.

In an exemplary embodiment, the second rivet station 516 forms the relieved bubble 12, and/or the rivet button 21, into the rivet button 22. The second rivet station includes the rivet station upper tooling assembly 700 and the rivet station lower tooling assembly 702, as well as the rivet station upper cap 710, the rivet station upper punch 714, the rivet station lower cap 716 and the rivet station lower punch 718, as described above. The rivet station upper tooling assembly 700 is structured to, and does, move between a first position, wherein the rivet station upper tooling assembly 700 is spaced from the rivet station lower tooling assembly 702, and a second position, wherein the rivet station upper tooling assembly 700 is adjacent the rivet station lower tooling assembly 702. Further, when the rivet station upper tooling assembly 700 and the rivet station lower tooling assembly 702 are in the second position, the rivet station upper tooling assembly 700 and the rivet station lower tooling assembly 702 are structured to, and do, form a rivet button 22.

In an exemplary embodiment, the rivet station upper punch 714 and the rivet station lower cap 716 are structured to, and do, move to the second position before the rivet station lower punch 718. In this configuration, the rivet station upper punch 714 and the rivet station lower cap 716 are structured to, and do, hold or clamp the shell 20, as defined above. After the shell is held/clamped, the rivet station lower punch 718 moves to the second position and forms the rivet button 21 into the rivet button 22.

In an exemplary embodiment, and as shown in FIG. 9A, the rivet station upper cap 710 includes a body with an upper end and a lower end. Further, the rivet station upper punch 714 includes a body 726 with an upper end 728 and a lower end 730. As shown, the rivet station upper punch body 726 is a hollow, generally cylindrical body. The rivet station lower cap 716 includes a body 740 with an upper end 742 and a lower end 744. The rivet station lower cap body upper end 742 is generally planar and defines a reference plane 746. That is, as used herein, the rivet station lower cap body upper end 742 is the "reference plane" 746 from which selected measurements, discussed below, are taken.

The rivet station lower punch 718 includes a generally cylindrical body 750 with an upper end 752 and a lower end 754. The rivet station lower punch body upper end 752 includes a generally rounded top portion 756, a generally cylindrical radial surface 758 and a generally curvilinear transition surface 760 therebetween. That is, when viewed in cross-section, as in FIG. 9A, the rivet station lower punch body upper end transition surface 760 is generally curvilinear. As use herein, the rivet station lower punch body upper end transition surface 760 "radius" is measured as the curvature of rivet station lower punch body upper end transition surface 760 when viewed in cross-section.

In one optional embodiment, as shown in FIG. 12B, the "radius" of the rivet station lower punch body upper end transition surface 760 may include a plurality of curvatures with each curvature having a distinct radius of curvature, such as but not limited to r1, r2, r3. By defining a plurality of curvatures of distinct radii r1, r2, and r3, and possibly others, the resulting rivet button 21, 22 will more effectively form a rivet 32 when pressed. Multiple radii allow for less stressing of the material during corner forming. In the illustrated embodiment, the first radius r1 is greater than the second radius r2, and the second radius r2 is greater than the third radius r3.

Figure 10:
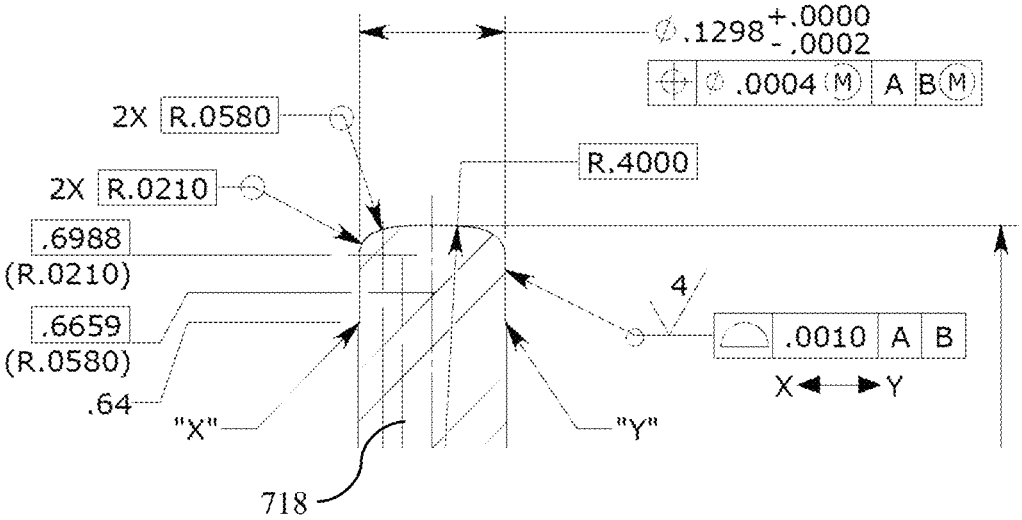
FIG. 10 is a schematic cross-sectional view of a lower punch of a first rivet station lower tooling assembly according to one embodiment of the presently disclosed technology.
Figure 11:
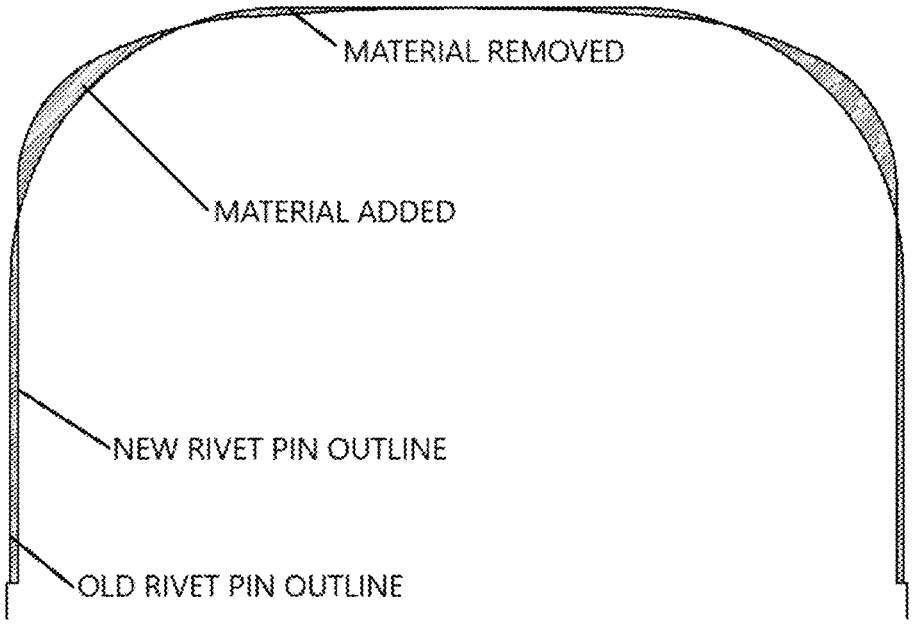
FIG. 11 is a schematic cross-sectional view of a prior art first rivet station compared to the disclosed first rivet station.

In an exemplary embodiment of FIGS. 9A-10, the first rivet button 21 includes a generally and/or at least slightly rounded top portion 44, which replaces the flat top of the prior art. The generally rounded top portion of the first rivet button 21 is formed by the generally rounded top portion 756 of the rivet station lower punch 718. The generally rounded top portion 756 supports the relieved bubble 12., This prevents or at least reduces stressing, stretching, and/or thinning of the first rivet button 21 when formed. Specifically, stressing, stretching, or tearing may occur at across a top surface of the first rivet button 21 corresponding to the rivet station lower punch body upper end transition surface 760. Reduction of this stressing, stretching, and thinning can be helpful when working with material that has a lower formability. The first rivet button 21 may include a relatively smaller diameter (compared to prior art rivets, as depicted in FIG. 11) to increase upper and lower clearances. In the exemplary embodiment of FIGS. 9A-10, the rivet station lower punch 718 of the first rivet button 21 has a diameter of 0.1478 inch and defines clearances of 0.009 inch per side to the rivet station upper punch 714. Furthermore, the first rivet button 21 of the present disclosure has a relatively lower height to further increase clearances. In the exemplary embodiment, the first rivet button 21 has a height between 0.037 and 0.077 inch, such as 0.057 inch. As a result of the multiple curvatures defined on the lower punch body upper end transition surface 760, the first rivet button 21 may comprise a plurality of radii, such as to further prevent thinning and stressing of the rivet 32 during formation. In an exemplary embodiment, the plurality of radii of the first rivet button 21 may include a first radius r1 between 0.3000 and 0.5000 inch, such as 0.4000 inch, a second radius r2 between 0.0380 and 0.0780 inch, such as 0.0580 inch, and a third radius r3 between 0.0110 and 0.0310 inch, such as 0.0210 inch.

Figure 13:
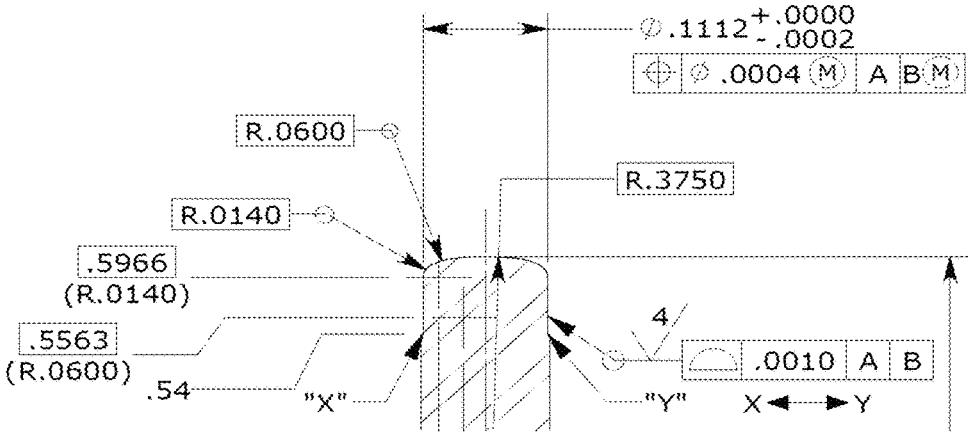
FIG. 13 is a schematic cross-sectional view of a lower punch of a second rivet station lower tooling assembly.
Figure 14:
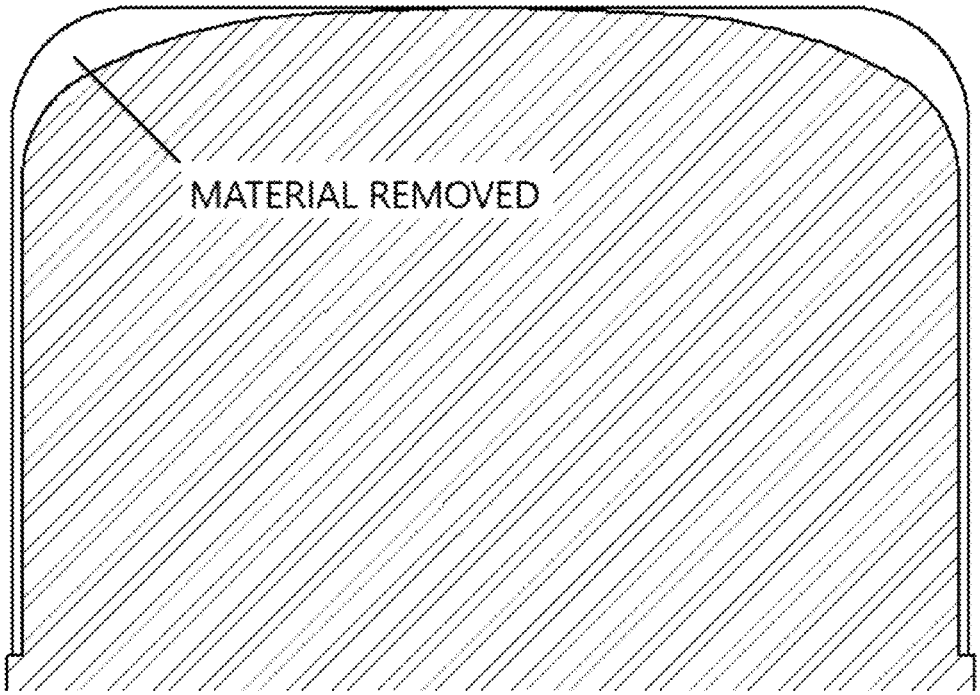
FIG. 14 is a schematic cross-sectional view of a prior art second rivet station compared to the disclosed second rivet station.

In an exemplary embodiment of FIGS. 12A-13, the second rivet button 22 includes a generally rounded top portion 44, which replaces the flat top of the prior art. The rounded top portion 756 of the second rivet upper punch 716 supports the first rivet button 21, and prevents or at least reduces stressing, stretching, and/or thinning when the second rivet button 22 is formed. Specifically, stressing, stretching, or tearing may occur at across a top surface of the second rivet button 22 corresponding to the rivet station lower punch body upper end transition surface 760. This can be helpful when working with material that has a lower formability. The second rivet button 22 may include a relatively smaller diameter (compared to prior art rivets, as depicted in FIG. 14) to increase upper and lower clearances. In the exemplary embodiment of FIGS. 12A-13, the second rivet insert 718 has a diameter of 0.1304 inch and defines clearances of 0.0096 inch per side. Furthermore, the second rivet button 22 of the present disclosure may have a relatively lower height to further increase clearances. In the exemplary embodiment, the second rivet button 22 has a height between 0.032 and 0.072 inch, such as 0.052 inch. As a result of the multiple curvatures defined on the lower punch body upper end transition surface 760, the second rivet button 22 may define a plurality of radii, such as to further prevent thinning and stressing of the rivet 32 during formation. In an exemplary embodiment, the plurality of radii of the second rivet button 21 may include a first radius r1 between 0.2750 and 0.4750 inch, such as 0.3750 inch, a second radius r2 between 0.0400 and 0.0800 inch, such as 0.0600 inch, and a third radius r3 between 0.0040 and 0.0240 inch, such as 0.0140 inch.

In operation, each rivet station upper punch 714 is structured to, and does, move between a first position, wherein the rivet station upper punch 714 is spaced from the rivet station lower cap body upper end 742, and a second position, wherein the rivet station upper punch 714 is immediately adjacent the rivet station lower cap body upper end 742. When the rivet station upper punch 714 is in the second position, the rivet station upper punch 714 and the rivet station lower cap 716 hold or clamp the shell 20 as defined above. Further, in an exemplary embodiment, the rivet station lower punch body upper end 752 is structured to, and does, move between a first position, wherein the rivet station lower punch body upper end 752 is not offset an effective distance to the reference plane 746, and, a second position, wherein the rivet station lower punch body upper end 752 is offset an effective distance to the reference plane 746. As used herein, an "effective distance" is a distance sufficient for the rivet station lower punch 718 to form a bubble 12 into a rivet button 22.

In an exemplary embodiment, and as shown in FIG. 15A, the number of stations 502 includes a staking station 800. As is known, a staking station 800 is structured to, and does, couple, directly couple, or fix a tab 50 to the shell 20. The staking station 800 includes a staking station upper tooling assembly 802 and a staking station lower tooling assembly 804. Prior to the staking station 800, a tab 50 is disposed over the rivet button 22 as described above. At the staking station 800, the staking station upper tooling assembly 802 is structured to, and does, move between a first position, wherein the staking station upper tooling assembly 802 is spaced from the staking station lower tooling assembly 804, and a second position, wherein the staking station upper tooling assembly 802 is adjacent, or immediately adjacent, the staking station lower tooling assembly 804. In this configuration, when the staking station upper tooling assembly 802 is in the second position, the staking station upper tooling assembly 802 and the staking station lower tooling assembly 804 are structured to, and do, form an expanded rivet 32 having an "enhanced overlap" of the tab body 52.

The method of forming a can end 30 with a rivet 32 includes any of the actions described above relating to forming a shell 20 with a relieved bubble 12. This includes providing a sheet material with a base thickness, forming the sheet material into a shell 20, and forming a relieved bubble 12 on the shell 20. The method of forming a can end 30 with a rivet 32 further includes preliminary forming the shell 20 into a can end 30, forming the relieved bubble 12 into a rivet button 22, and performing finishing operations on the shell 20/can end 30.

Narrow Blade Scoring

The scoring station is or may be the fourth step in the development of a can end. By changing the dimensions of a typical or prior art can end, for example at particular locations and/or by a particular amount, the presently disclosed technology makes it possible and/or easier to use materials of lower formability, and/or less expense to create a can end that meets performance requirements.

Figure 16:
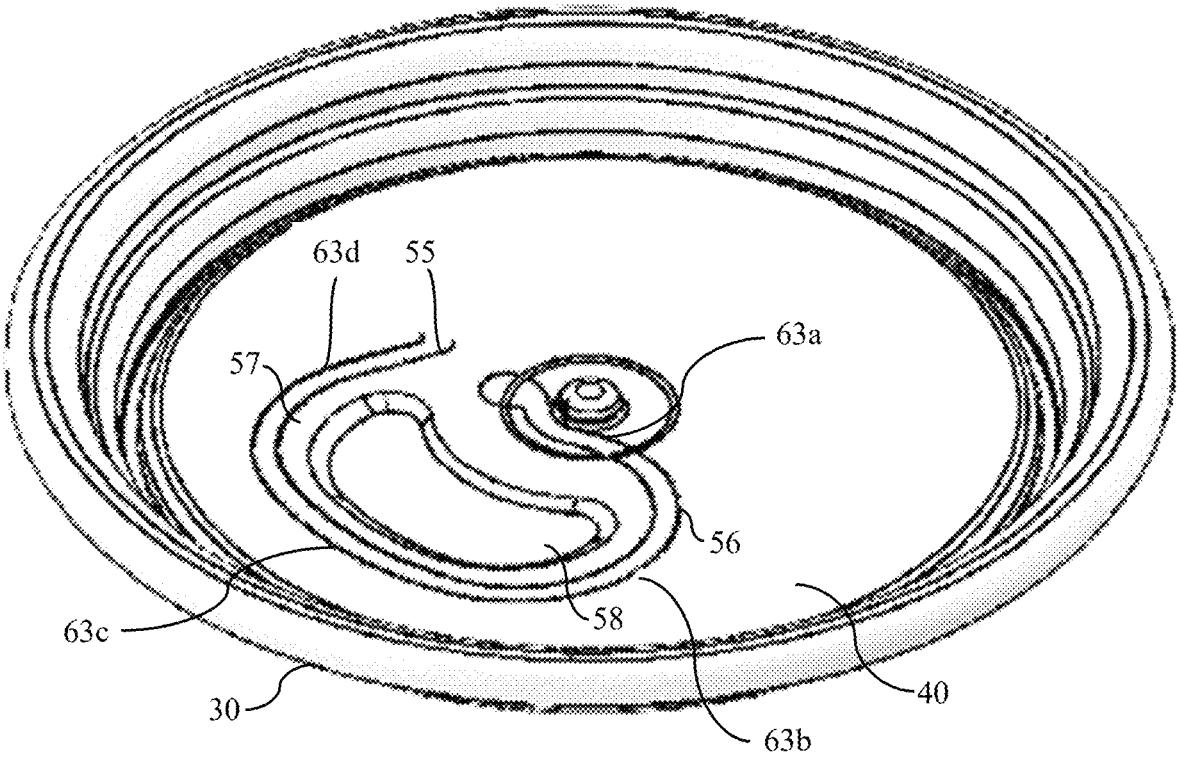
FIG. 16 is a perspective view of a can end after undergoing a score station according to one embodiment of the presently disclosed technology.

FIG. 16 shows a can end 30 which has undergone scoring in a scoring station. The can end 30 includes a score having a main score 55 and an anti-fracture score 56. The main score is configured to break when a tab 50, or similar mechanism, is pressed against a tear panel 57. The anti-fracture score 56 is configured to provide a defense to breakage of the main score 55 by providing a counteracting force during scoring, and when the can end 30 is subjected to forces, such as paneling. For example, the anti-fracture score 56 will prevent weakening of the main score 55 when a shadow bead 58 is defined on the tear panel 57.

The score 55, 56 is not generally straight along the entire length. In an exemplary embodiment, the score 55, 56 extends around the tear panel 57 that, as shown, is generally oval shaped. Thus, for an exemplary beverage can closure, the score 55, 56 length extends substantially about an oval shape. More specifically, the main score 55 and the anti-fracture score 56 extend generally parallel to each other and in a generally oval pattern. That is, the main score 55 and the anti-fracture score 56 are not straight, but at any given location, the main score 55 and the anti-fracture score 56 are generally parallel to each other. The main score 55 extends substantially about and immediately adjacent the tear panel 57. The score 55, 56 also includes a "U" shaped portion wherein the main score 55 doubles back and becomes the anti-fracture score 56. The "U" shaped portion is the transition between the main score 55 and the anti-fracture score 56. The anti-fracture score 56 then extends about the main score 55 and the tear panel 57. As is known, on a can end 30, the score 55, 56 does not extend entirely about the tear panel 57. In this configuration, there is a connection tab, or hinge, that links the tear panel 57 to the end panel 40. Thus, as used herein, the score 55, 56 extends "substantially about" the tear panel 57 meaning that the score 55, 56 extends about the tear panel 57 other than the portion that defines the hinge discussed above.

Figure 17A:
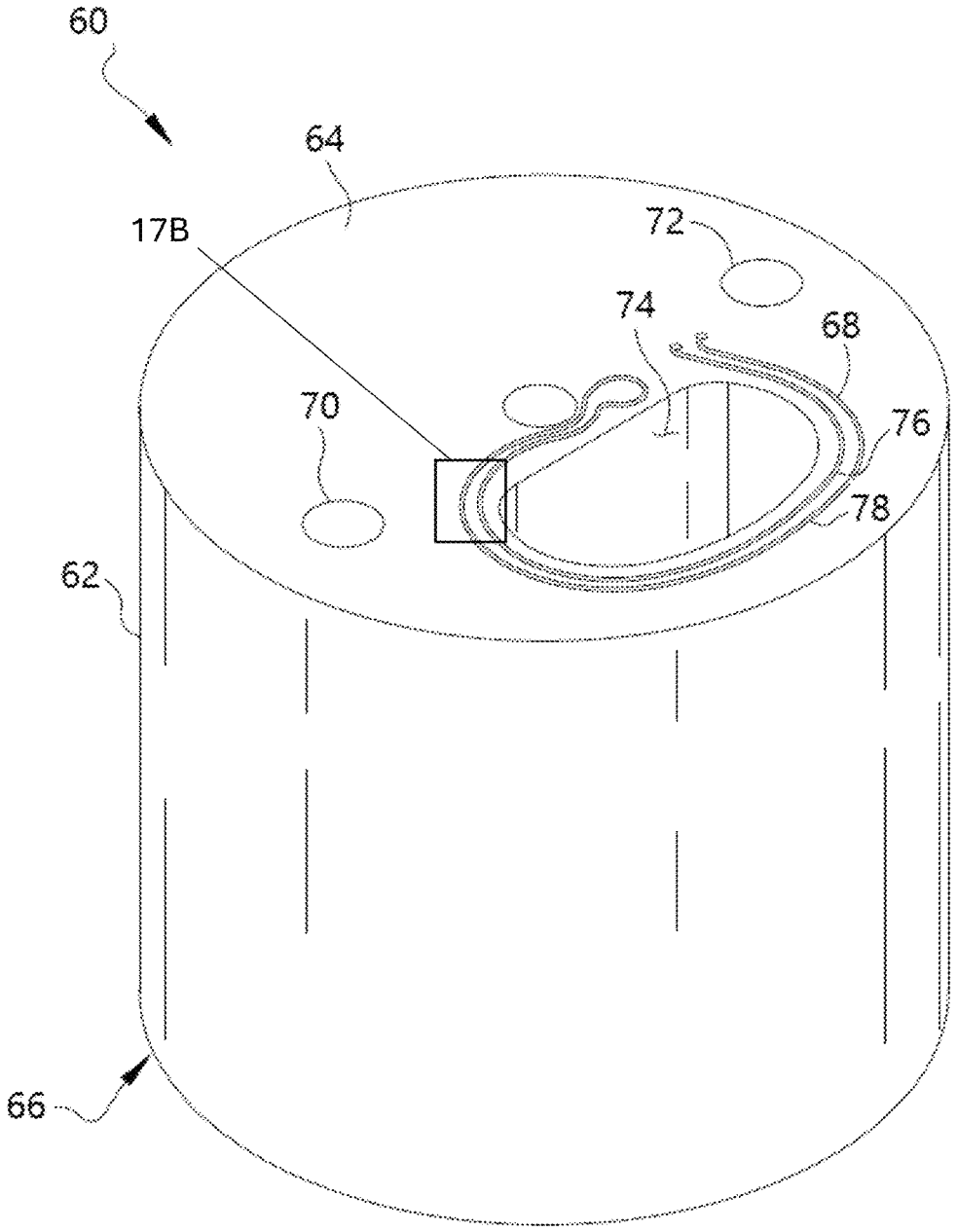
FIG. 17A is an isometric view of a score die according to one embodiment of the presently disclosed technology.

FIG. 17A shows a score die 60 including a body 62. The score die body 62, in an exemplary embodiment, is generally cylindrical and includes a generally planar axial first surface 64 (see FIG. 17B) and an opposing generally planar axial second surface 66. The die body first surface 64 includes a score blade 68. The score blade 68 extends from the plane of the die body first surface 64. The score die body 62 further includes a number of openings such as, but not limited to, two dowel (or mounting) openings 70, 72 and a tear panel opening 74. As is well known, the dowel (or mounting) openings 70, 72 are used to mount the score die body 62 in a press and/or on forming assemblies when the score die body 62 is being made. As is known, the tear panel opening 74 corresponds to the location and shape of a tear panel on a can end. The score blade 68 extends substantially about the tear panel opening 74.

Figure 17B:
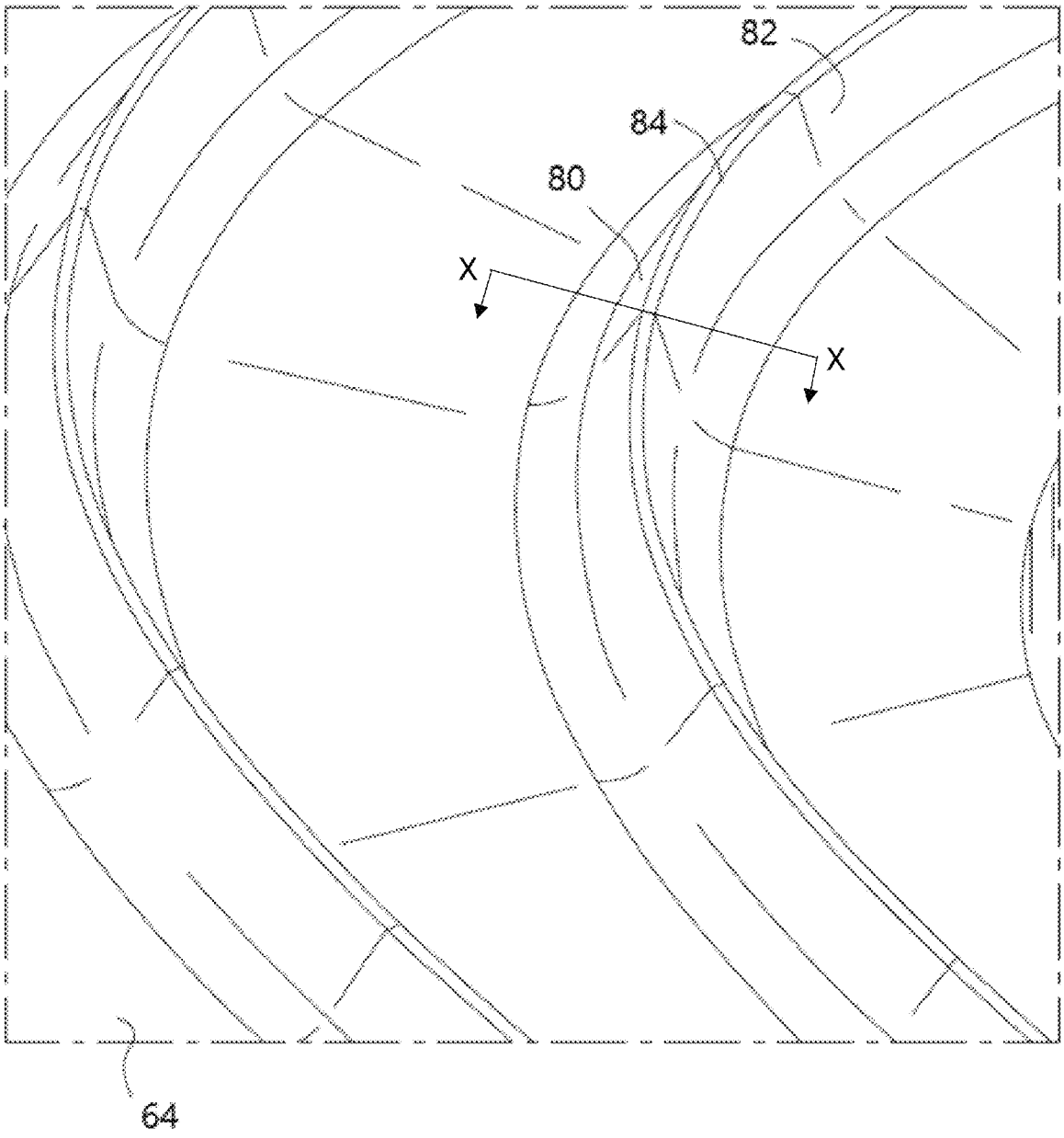
FIG. 17B is detail view of area 17B of FIG. 17A of a score blade on a score die according to one embodiment of the presently disclosed technology.

In an exemplary embodiment, and as shown in FIG. 17B, the score blade includes two substantially planar surfaces 80, 82 (when viewed in cross-section and/or at any specific location). In this exemplary embodiment, the score blade when viewed in cross-section has a shape that is, essentially, an inverted "V." It is understood that this shape is exemplary and that a score blade, in other embodiments, has other cross-sectional shapes that include more than two surfaces. The following description uses the inverted "V" shape score blade 68 as an example, but it is understood that the description of the score die 60, as well as the system and method discussed below, are applicable to score blades with more than two surfaces.

In an exemplary embodiment, the score blade 68 has a number of cutting portions 76, 78 (two shown). That is, as used herein, a score blade "cutting portion" serves to create a specific type of score in a can end. In the exemplary embodiment shown, the score blade 68 includes a primary score, first cutting portion 76 (also identified commonly as the "score" blade) and an anti-fracture, second cutting portion 78 (also identified commonly as the "anti-fracture" blade). As used herein, the "score blade" 68 includes both cutting portions described herein.

Further, the score blade 68 has a "length." The score blade 68 is not generally straight along the entire length. For a beverage can, the score blade 68 extends substantially about the tear panel opening 74 that, as shown, is generally oval shaped. Thus, for a beverage can closure, the score blade 68 length extends substantially about an oval shape. More specifically, the first cutting portion 76 and the second cutting portion 78 extend generally parallel to each other and in a generally oval pattern. That is, the first cutting portion 76 and the second cutting portion 78 are not straight, but at any given location, the first cutting portion 76 and the second cutting portion 78 are generally parallel to each other. As is known, the first cutting portion 76 extends substantially about and immediately adjacent the tear panel opening 74. The score blade 68 also includes a "U" shaped portion wherein the first cutting portion 76 doubles back and becomes the second cutting portion 78. The "U" shaped portion is the transition between the first and second cutting portions, 76, 78. The second cutting portion 78 then extends about the first cutting portion 76 and the tear panel opening 74. As is known, on a can end, the score line does not extend entirely about the tear panel. In this configuration, there is a connection tab, or hinge, that links the tear panel to the end panel. Thus, as used herein, the score blade 68 extends "substantially about" the tear panel opening 74 meaning that the score blade 68 extends about the tear panel opening 74 other than the portion that defines the hinge discussed above.

As noted above, in the exemplary embodiment shown, both the first cutting portion 76 and the second cutting portion 78 each have an inverted "V" shape when viewed in cross-section. Thus, the score blade 68, i.e., each cutting portion 76, 78, includes an associated first surface 80 and second surface 82. When viewed in cross-section, these surfaces are generally, or substantially, planar. The score blade first surface 80 and the score blade second surface 82 meet at a flat vertex 84 (see FIG. 17B). That is, when viewed in cross-section, the score blade 68 appears as a triangle with a truncated top. As used herein, a "flat vertex" means the flat at the top of such a truncated triangle. The score blade 68, i.e., each portion 76, 78, has a "thickness" that is measured at the flat vertex 84 which is the cutting surface of the score blade 68. The "thickness" is measured between the score blade first surface 80 and the score blade second surface 82 and along a line that is generally perpendicular to a longitudinal line that follows the shape of the blade. That is, the "thickness" is measured as the shortest length across the flat vertex 84. Further, the score blade 68, i.e., each portion 76, 78, has a "height" that is measured between the flat vertex 84 and at the interface with the die body first surface 64. Further, the score blade 68, i.e., each portion 76, 78, "angle" is measured between the first surface 80 and the second surface 82. That is, the truncated portion of the "flat vertex" is ignored and the angle is identified as the blade "angle," the "vertex angle" and/or "angle of the vertex." As used herein, the score blade 68 "thickness," "height," and "(vertex) angle" are all measured as part of a cross-section. It is noted that, among other characteristics, the thickness, height and angle of a hand polished score blade are generally variable along the length of the score blade.

The disclosed and claimed score die 60, however, includes a score blade 68 wherein each cutting portion 76, 78 has a substantially uniform cross-section. As used herein, "substantially uniform cross-section" means that the thickness, height and/or angle of the cutting portion 76, 78 does not change substantially along the length of the score blade 68, or, along each cutting portion 76, 78. That is, as used herein, "does not change substantially" means that any of the characteristics of thickness (at the flat vertex), height and/or angle of either cutting portion 76, 78 does not change by more than 10 percent along the length of the cutting portion 76, 78.

Further, in an exemplary embodiment, the thickness (at the flat vertex) of the first cutting portion 76 does not vary more than 0.0002 along the length of the first cutting portion 76. Further, the angle of the first cutting portion 76 does not vary more than a quarter of a degree along the length of the first cutting portion 76. Further, in an exemplary embodiment, the height of first cutting portion 76 does not vary more than 0.0002 inch along the length of the first cutting portion 76. Similarly, the thickness (at the flat vertex) of the second cutting portion 78 does not vary more than 0.0002 along the length of the second cutting portion 78. Further, the angle of the second cutting portion 78 does not vary more than a quarter of a degree along the length of the second cutting portion 78. Further, in an exemplary embodiment, the height of second cutting portion 78 does not vary more than 0.0002 inch along the length of the second cutting portion 78.

That is, each cutting portion 76, 78 may have a cross-sectional shape that is different from the other cutting portion 76, 78. Moreover, when compared to another score die 60, the score blades 68 also have a "substantially similar uniform cross-section." As used herein, a "substantially similar uniform cross-section" means that score blades on different score dies 60 each have a "substantially uniform cross-section" and that the "substantially uniform cross-section(s)" are substantially similar to each other. A score die 60, or score die blank, with a substantially uniform cross-section solves the problem(s) noted above. Further, different score dies 60 with score blades 78 having "substantially similar uniform cross-section" also solves the problem(s) noted above.

Figure 18:
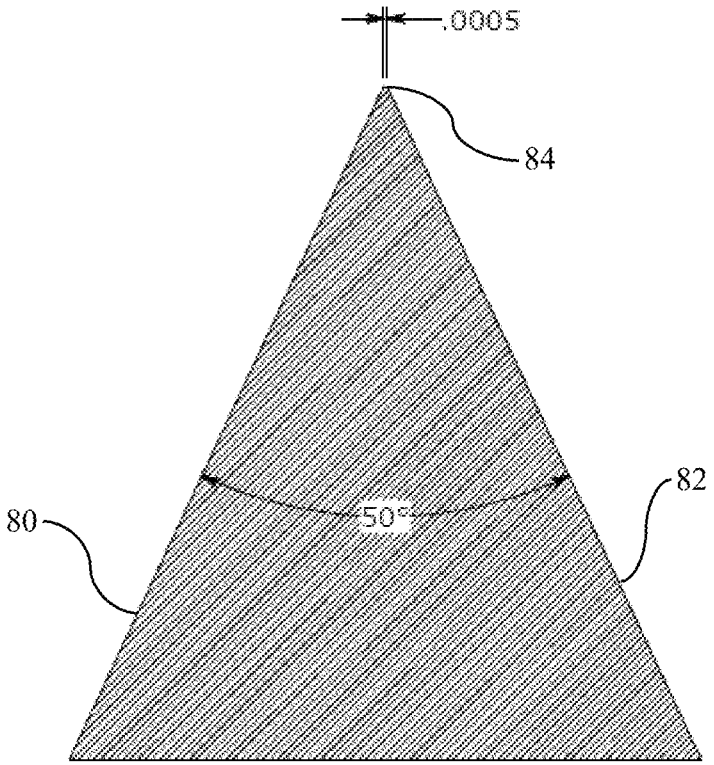
FIG. 18 is a schematic cross-sectional view taken from line X-X of FIG. 17B of a score die according to one embodiment of the presently disclosed technology.

In an exemplary embodiment, shown in FIG. 18, the blade angle between the first cutting portion 80 and the second cutting portion 82 is 50 degrees. Furthermore, in the exemplary embodiment, the flat vertex 84, and the thickness of the score die 68, is 0.0005 inch. This is in contrast to the prior art, which may have a larger flat vertex of 0.0012 inch. By providing a relatively narrow flat vertex 84 as compared to the prior art, the score die 68 may define a main score 55 and/or anti-fracture score 56 with a respectively narrow width. The main score 55 may have a width between 0.0002 and 0.0008 inch. In an exemplary embodiment, the main score 55 has a width of 0.0005 inch (see FIG. 18). Furthermore, in an exemplary embodiment, the anti-fracture score 56 has a width of 0.0012 inch.

Generally, a score with a greater residual will incur increased opening forces. Furthermore, a score cut with a narrow blade will generally incur lower pressure resistance. By providing a main score 55 with width defined within the aforementioned range, the main score 55 will improve pressure resistance by allowing thicker score residuals while also maintaining lower opening forces. Thicker score residuals provide better resistance to paneling. Furthermore, the narrow score 55, 56 causes less loose metal on the can end 30, in turn requiring less paneling. In an exemplary embodiment, the main score 55 has a lesser residual than the anti-fracture score 56. As such, the main score 55 will be less resistant to opening than the anti-fracture score 56. In the exemplary embodiment, the anti-fracture score 56 is between 0.001 and 0.003 inch shallower than the main score 55. For example, the antifracture score 56 may be 0.002 inch shallower than the main score.

Figure 19A:
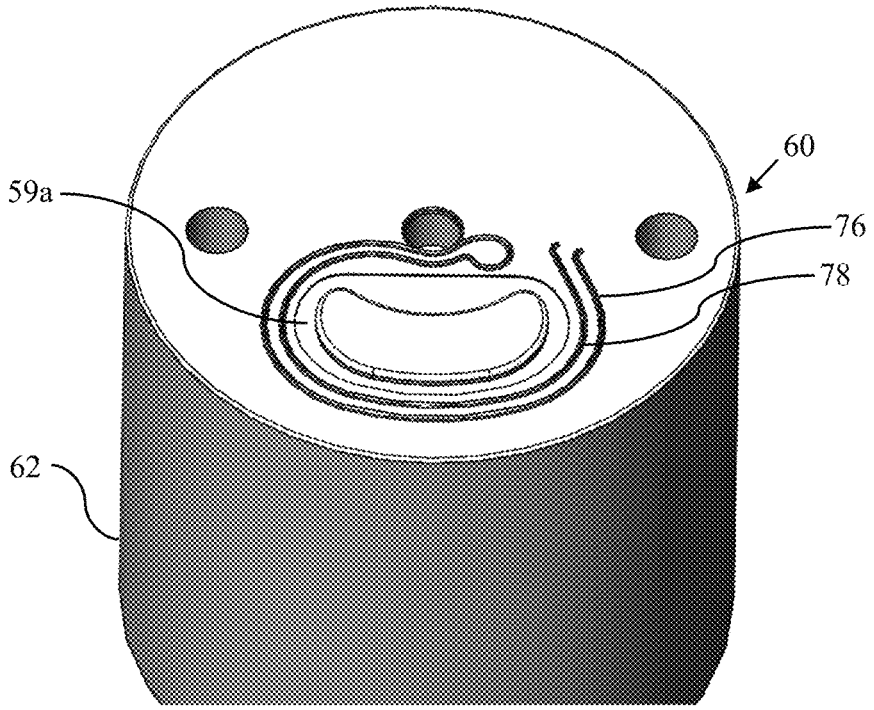
FIG. 19A is a perspective view of a score die according to the presently disclosed technology.
Figure 19B:
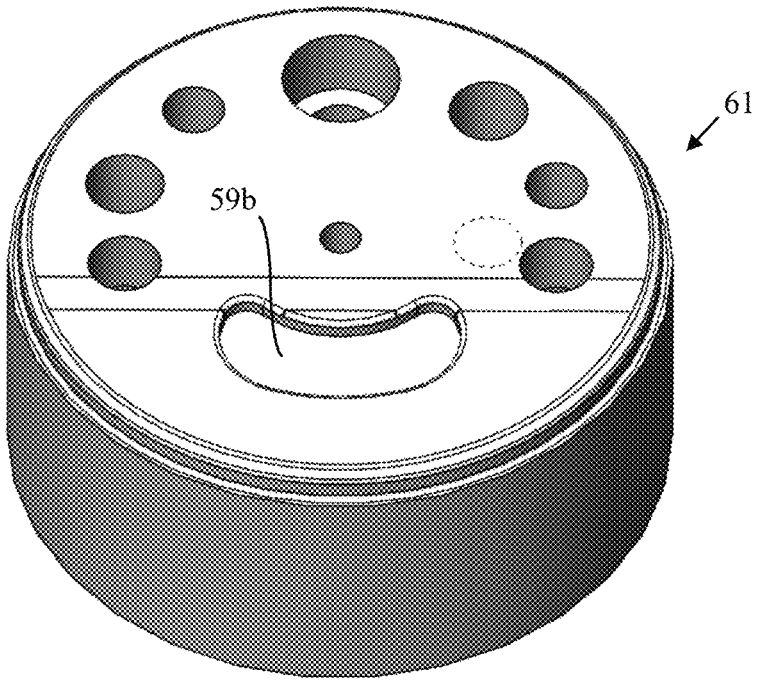
FIG. 19B is a perspective view of a score anvil according to the presently disclosed technology.

In the exemplary embodiment, the tear panel 57 includes a shadow bead 58 (FIG. 16). The shadow bead 58 is located inwardly pressed into the tear panel 57 and is configured to reduce loose metal from the tear panel 57. The shadow bead 58 is formed during scoring by pressing the can end 30 between a shadow bead insert 59*a* and a shadow bead cavity 59*b* (FIG. 19B) defined on a scoring anvil 61. The shadow bead cavity 59*b* can optionally have a bean shape that forms a cavity in the scoring anvil 61. The shadow bead insert 59*a* is configured to fit in the tear panel opening 74 such that the resulting shadow bead 58 will be defined on the tear panel 57.

Referring to FIG. 16, in addition to reducing the blade width of the score, the residual thickness of material of scoring on the final can end is increased from nominal 0.0036-0.0042 inch as found in the prior art, to 0.0045-0.0057 inch (FIG. 16). The 0.0045-0.0057 inch score residual would be too thick for use with the narrow score blade because it would require significantly more force to open the can, resulting in poor can end performance. In the exemplary embodiment, the score residual is nominally about 0.0057 inch at the 12:00 o'clock position 63*a* and nominally about 0.0045 at the 3:00 o'clock position 63*b*, the 6:00 o'clock position 63*c*, and the 9:00 o' clock position 63*d*.

The presently disclosed technology also changes the score station by removing a non-forming insert with one that forms the beer/beverage can end as it gets scored. Specifically, in the exemplary embodiment of FIG. 19A, the shadow bead insert 59*a* forms the can end during scoring. The anvil in the lower score station as shown in the exemplary embodiment of FIG. 19B, has a cavity 59*b* incorporated into it that will form the metal in conjunction with the new upper insert shown in FIG. 19A. This allows the metal to be formed as it is being displaced by the score blade. Prior designs have this metal forming occurring after the scoring operation resulting in the score being weakened. Thus, in the present embodiment, metal forming occurs during the score operation rather than afterwards.

Improved Panel

The panel station is or can be the fifth step in the development of a can end. By changing the dimensions of a typical or prior art can end, for example at particular locations and/or by a particular amount, the presently disclosed technology makes it possible and/or easier to use materials of lower formability and/or less expense to create a can end that meets performance requirements.

Figure 20:
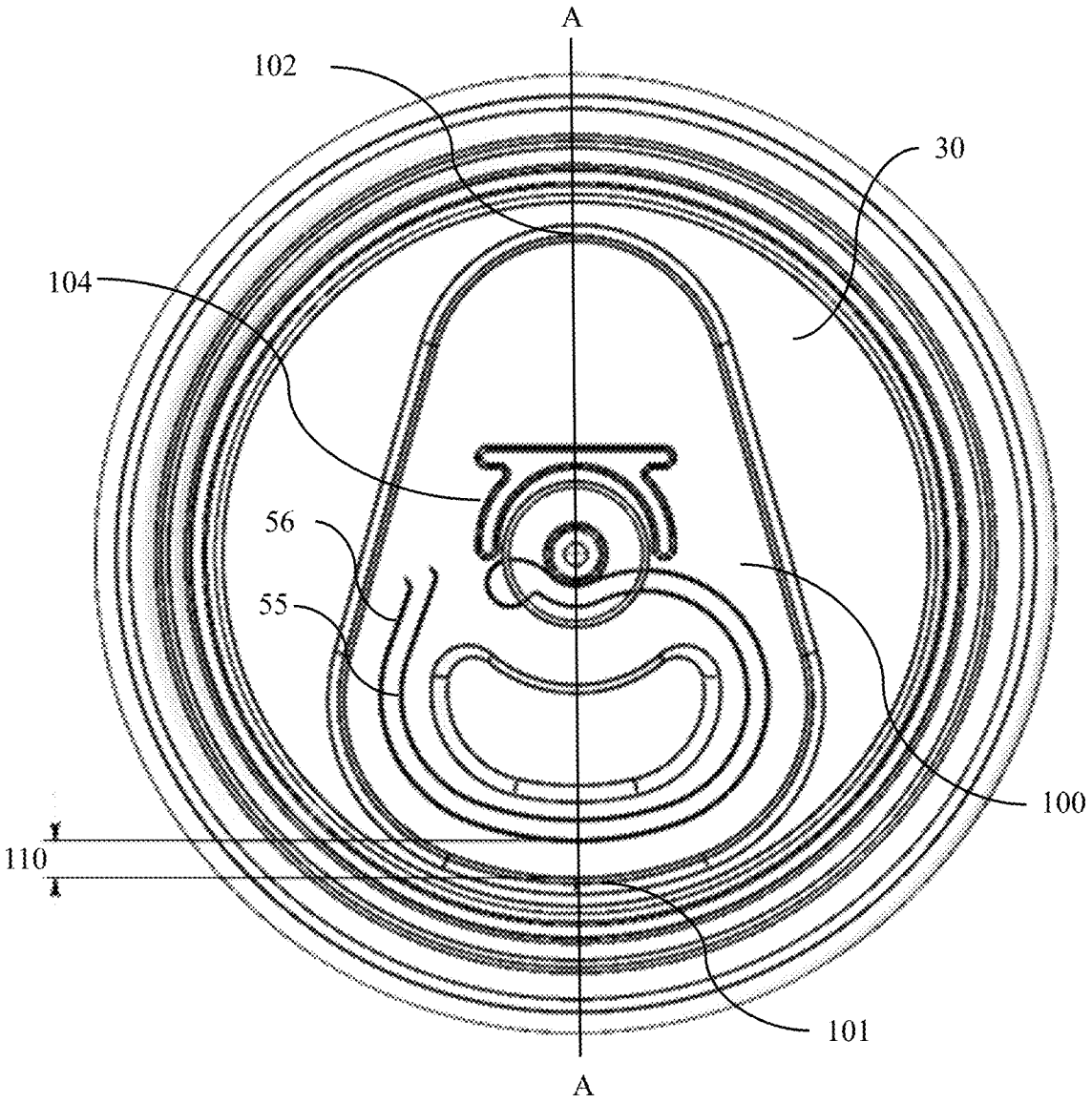
FIG. 20 is a perspective view of a can end after undergoing a paneling station according to one embodiment of the presently disclosed technology.
Figure 21:
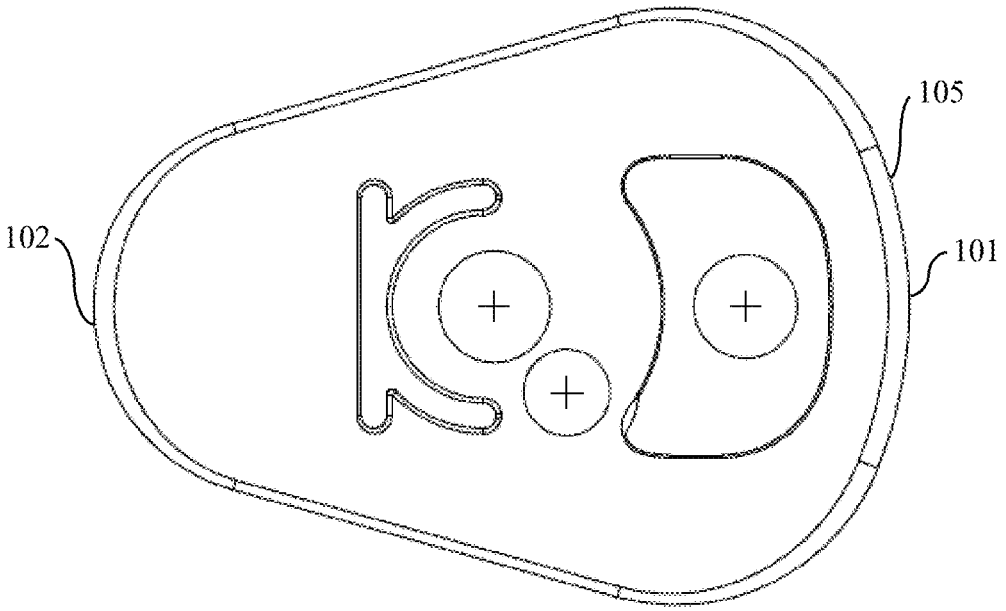
FIG. 21 is a top down view of an upper panel insert of a paneling station upper tooling assembly according to one embodiment of the presently disclosed technology.
Figure 22:
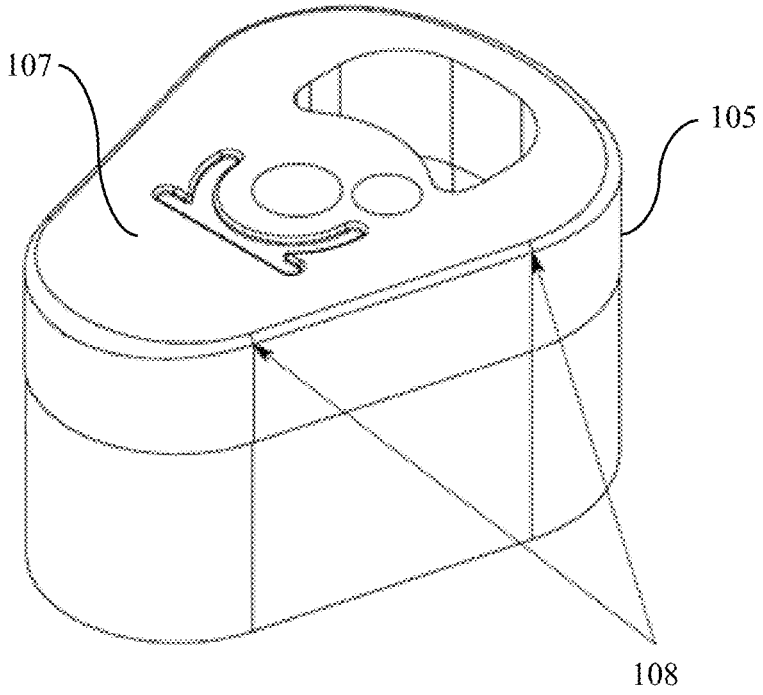
FIG. 22 is a perspective view of an upper panel insert of a paneling station upper tooling assembly.

FIG. 20 shows a can end 30 with a panel 100 formed thereon according to one embodiment of the presently disclosed technology. The panel 100 is configured to reduce loose metal on the can end 30, which could lead to breakages on the can end 30. For example, the panel 100 reduces bending at the score area of the can end 30, particularly at the main score 55 where breakage could result in a release of product from the main score 55. In an exemplary embodiment, the panel 100 defines a front end 101 disposed opposite a back end 102. In the exemplary embodiment, the front end 101 of the panel 100 is wider than the back end 102 of the panel 100 in order to accommodate a score area (i.e., the area surrounding and including the score 55, 56) of the can end 30.

Figure 23:
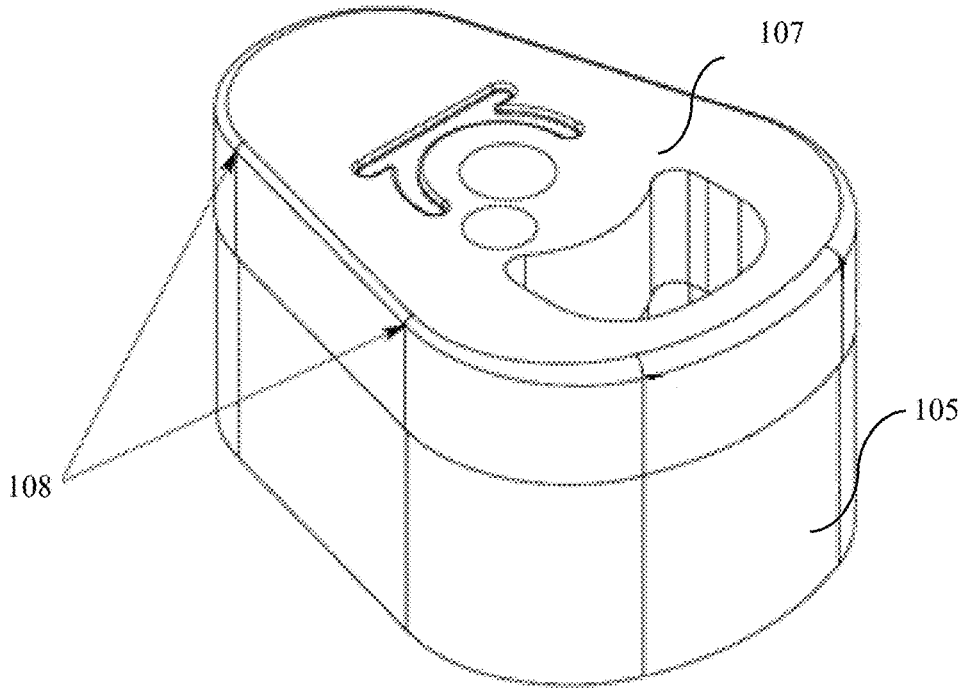
FIG. 23 is a perspective view of an upper panel insert of a paneling station upper tooling assembly according to one embodiment of the presently disclosed technology.
Figure 24:
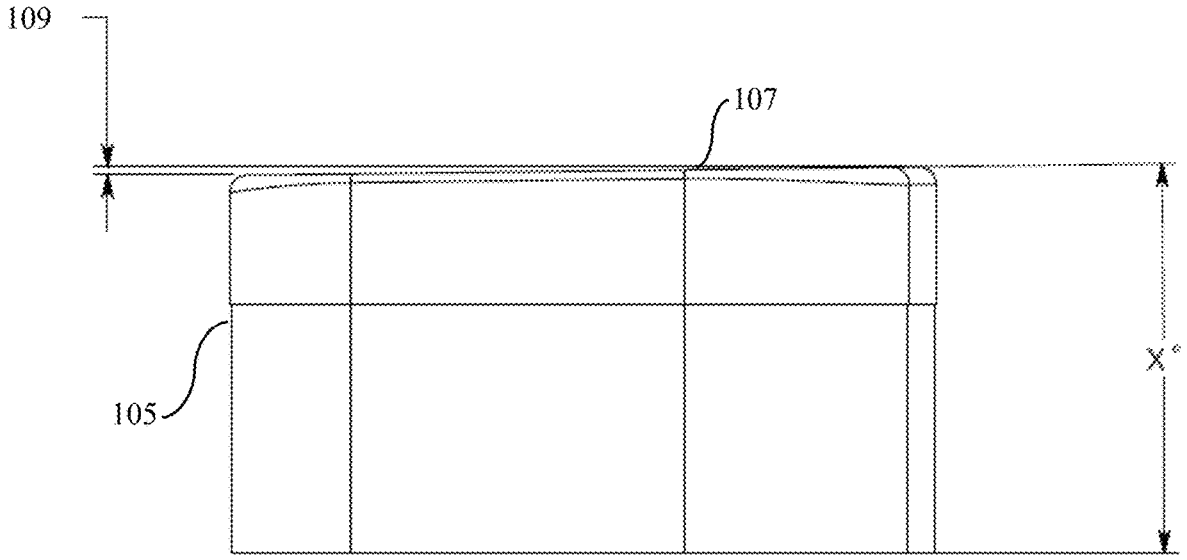
FIG. 24 is a side elevation view of an upper panel insert of a paneling station upper tooling assembly according to one embodiment of the presently disclosed technology.
Figure 25:
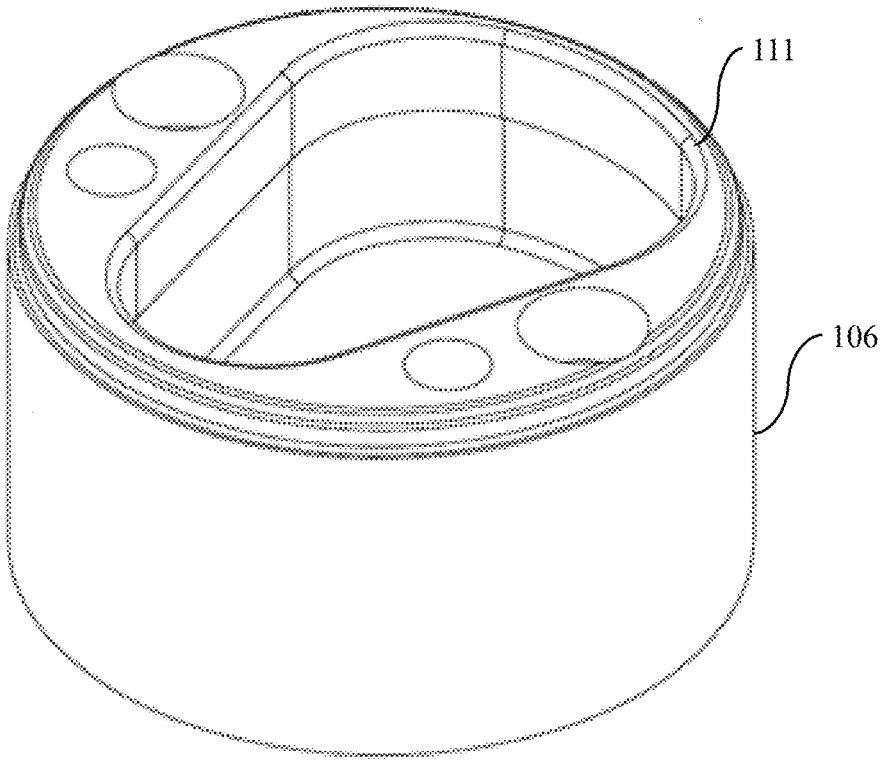
FIG. 25 is a perspective view of a lower panel cap of a paneling station lower tooling assembly according to one embodiment of the presently disclosed technology.

The panel 100 is formed in a paneling station in which the can end 30 is pressed between an upper panel insert 105 (shown in FIGS. 21-24) and a lower panel cap 106 (shown in FIG. 25). The upper panel insert 105 may include a contact surface 107 which is pressed against the can end 30 in the paneling station. In the prior art, the contact surface 107 is generally planar and comprises a rounded edge around the entirety of the perimeter of the upper panel insert 105. In an exemplary embodiment of the presently disclosed technology, a pair of opposing side portions 108 (FIG. 23) of the perimeter of the upper panel insert 105, corresponding to the rivet button 22, have a lower or smaller radius than the remaining portions of the perimeter of the upper panel insert 105. As such, metal forming during paneling can be concentrated at the rivet button 22. In one exemplary embodiment, the radius of the pair of side portions 108 of the upper panel insert 105 is smaller than the radius of the remaining portions of the upper panel insert 105. For example, in an exemplary embodiment, the radius of the pair of side portions 108 can be between 0.01 and 0.03 inch, such as 0.02 inch, while the radius of the remaining portions of the upper panel insert 105 can be between 0.03 and 0.05 inch, such as 0.04 inch. This increased radius at the front and rear portions of the upper panel insert 105 is distinct from the prior art, which has a front radius of curvature of only 0.02 inch and a side radius of curvature of only 0.015 inch around the remainder of the perimeter of the upper panel insert 105. Prior art paneling is deeper and/or more formed that the presently disclosed technology. Including the radii explained herein in the prior art paneling would result in too much metal that can ends would have inadequate or undesirable performance.

Figure 26:
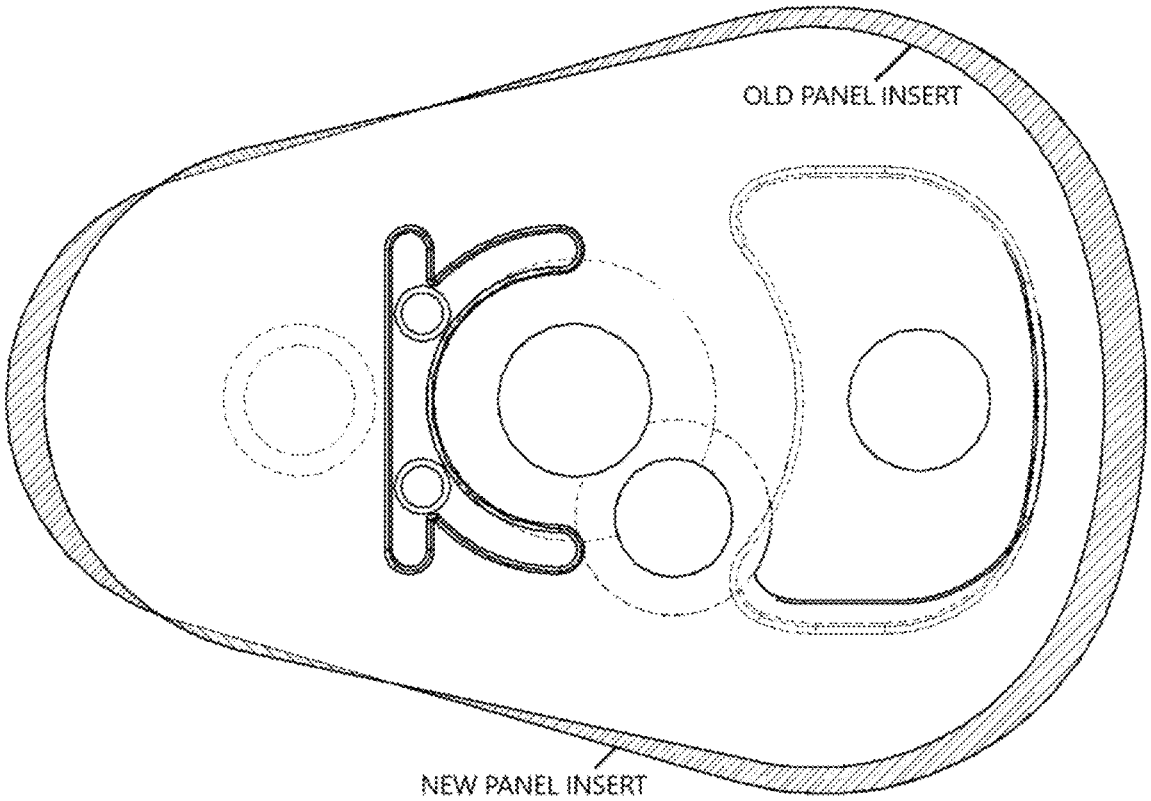
FIG. 26 is a schematic cross-sectional view of a prior art upper panel insert compared to the disclosed upper panel insert of a paneling station upper tooling assembly.

The panel 100 of the exemplary embodiment of the presently disclosed technology is larger (e.g., when viewed from above) than traditional panels known in the prior art, wherein the relative differences between them is depicted in FIG. 26. The increased size of the panel 100 of the presently disclosed technology, specifically near the score area, defines an increased distance 110 (see FIG. 20) between the score 55, 56 and the perimeter of the panel 100.

The distance between the outer periphery of the panel and the score along the imaginary axis A-A is greater than 0.080 inch. In some embodiments, the distance is greater than 0.090 inch. In further embodiments, the distance is between 0.060 and 0.100 inch. The increased distance between the score 55, 56 and the perimeter of the panel 100 prevents inadvertent or unexpected breaking of the score 55, 56 and/or puts less strain on the brittle material and/or the score 55, 56 during formation of the can end 30, particularly during the paneling station, and particularly when using materials with lower formability and/or less expense. However, if the distance between the outer periphery of the panel and the score 55, 56 is too great, the buckle strength of the can end will be compromised. That is, the purpose of the paneling is to absorb loose metal. If the score 55, 56 is too far away from the perimeter of the panel 100, the paneling will be formed from metal from other areas of the can end instead of the excess loose metal at the score 55, 56, compromising buckle strength. Alternatively, if the score 55, 56 is too close to the perimeter of the panel 100, too much loose metal will be drawn from the score 55, 56, the integrity of the score 55, 56 will be compromised.

Furthermore, as shown in FIG. 24, the panel 100 of the exemplary embodiment is at least slightly tapered from the front end 101 of the panel 100 to the rear end 102 of the panel 100. In contrast, upper panel inserts of the prior art have top and bottom surfaces that are parallel. The taper 109 of the presently disclosed technology allows for more localized forming to occur at the score area of the can end 30, where there is a greater amount of loose metal, and less forming to occur at the 12:00 o'clock position, preventing or at least reducing compromising buckle strength. In an exemplary embodiment, the taper 109 is between 0.001 and 0.005 inch. For example, in one exemplary embodiment, the taper 109 is 0.003 inch.

In an exemplary embodiment, as shown in FIG. 20, the panel 100 defines a cent bead 104 extending upwardly from the can end 30. An imaginary axis A-A extends through a center of the can end 30 and evenly divides the cent bead 104. The cent bead 104 is configured to assist with directing pressure towards the tear panel 57 when a tab 50, or similar mechanism, is engaged by a user. The cent bead 104 is formed when a cent bead insert is placed into the lower panel insert 105 such that the cent bead 104 will extend upward from the can end 30. In the illustrated embodiment, the cent bead 104 is chamfered around an entire perimeter thereof.

In an illustrated embodiment, as shown in FIG. 25, the lower panel cap 106 defines a pocket 111. The pocket 111 may include a rounded edge, such as to prevent stressing while during forming of the panel 100. The pocket 111 of the exemplary embodiment has a larger radius of curvature between 0.020 and 0.040 inch, such as 0.03 inch, around the entire pocket 11, as compared to the prior art, which has a radius of curvature of 0.015 inch at sides of the pocket.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A can end, comprising:

a rivet button extending upward from the can end, the rivet button comprising a top portion with a sidewall having a rounded profile, the rounded profile comprising three or more curvatures defined between the top portion of the rounded profile and a medial portion of the sidewall, each curvature having a distinct radius of curvature.

2. The can end of claim 1, wherein the plurality of curvatures comprises a first curvature with a first radius at a top portion of the rounded profile, a second curvature with a second radius at transition portion of the rounded profile, and a third curvature with a third radius at a sidewall of the rounded profile, wherein the first radius, the second radius, and the third radius are not equal.

3. The can end of claim 2, wherein the first radius is greater than the second radius, and wherein the second radius is greater than the third radius.

4. The can end of claim 2, wherein the first radius is between 0.3000 and 0.5000 inches, the second radius is between 0.0380 and 0.0780 inches, and the third radius is between 0.0110 and 0.0310 inches.

5. The can end of claim 2, wherein the first radius is between 0.2750 and 0.4750 inches, the second radius is between 0.0400 and 0.0800 inches, and the third radius is between 0.0040 and 0.0240 inches.

6. The can end of claim 1, wherein the rivet button is formed from a relieved bubble previously disposed on the can end.

7. The can end of claim 1, wherein the rivet button has a diameter of 0.1478 inches.

8. The can end of claim 1, wherein the rivet button has a height between 0.037 and 0.077 inches.

9. The can end of claim 1, wherein the rivet button has a diameter of 0.1304 inches.

10. The can end of claim 1, wherein the rivet button has a height between 0.032 and 0.072 inches.

11. The can end of claim 1, wherein the top portion and the sidewall of the rivet button are entirely rounded above a base of the sidewall.

12. The can end of claim 10, wherein the sidewall is convex between a top portion of the rivet button and a base of the sidewall of the transition portion.

13. The can end of claim 1, wherein the rivet button is free of any flat surfaces.

* * * * *